US009792770B2

(12) United States Patent
Costello et al.

(10) Patent No.: US 9,792,770 B2
(45) Date of Patent: Oct. 17, 2017

(54) PLAY FOR FUN NETWORK GAMING SYSTEM AND METHOD

(71) Applicant: Bally Gaming, Inc., Las Vegas, NV (US)

(72) Inventors: Andrew Costello, Las Vegas, NV (US); Louis J. Castle, II, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 6 days.

(21) Appl. No.: 13/624,743

(22) Filed: Sep. 21, 2012

(65) Prior Publication Data

US 2013/0184060 A1 Jul. 18, 2013

Related U.S. Application Data

(60) Division of application No. 13/609,031, filed on Sep. 10, 2012, now Pat. No. 8,974,305, which is a continuation-in-part of application No. 13/353,194, filed on Jan. 18, 2012, now Pat. No. 9,120,007.

(51) Int. Cl.
*G07F 17/32* (2006.01)

(52) U.S. Cl.
CPC ..... *G07F 17/326* (2013.01); *G07F 17/3223* (2013.01); *G07F 17/3241* (2013.01)

(58) Field of Classification Search
CPC ..... G07F 17/32
USPC ..... 463/16, 17, 19, 20, 42
See application file for complete search history.

(56) References Cited

U.S. PATENT DOCUMENTS

| | | | |
|---|---|---|---|
| 4,339,798 | A | 7/1982 | Hedges et al. |
| 4,373,726 | A | 2/1983 | Churchill et al. |
| 4,592,377 | A | 6/1986 | Paulsen et al. |
| 4,725,079 | A | 2/1988 | Koza et al. |
| 4,832,341 | A | 5/1989 | Muller et al. |
| 4,948,138 | A | 8/1990 | Pease et al. |
| 5,007,649 | A | 4/1991 | Richardson |

(Continued)

FOREIGN PATENT DOCUMENTS

| | | | |
|---|---|---|---|
| CA | 2 529 076 | A1 | 6/2006 |
| CN | 1894694 | A | 1/2007 |

(Continued)

OTHER PUBLICATIONS

U.S. Appl. No. 13/860,991, filed Apr. 11, 2013, and titled "Interactive Financial Transactions," to Andrew Costello.

(Continued)

*Primary Examiner* — Reginald Renwick
(74) *Attorney, Agent, or Firm* — Marvin A. Hein, Jr.

(57) ABSTRACT

A network based play for fun gaming system and method that includes allocating a first number of achievable elements to said player based at least in part on at least one of a number of games completed by a user, a total amount of said wagers of said player in one or more games, and/or a total amount of winnings and/or losses by a player, wherein said achievable elements do not affect the game outcome. The achievable elements may also be purchased by a player and used to unlock additional features, speed play, assign additional players, provide additional features, provide additional bonuses, and/or provide a user the option to modify the player's play for fun experience.

7 Claims, 17 Drawing Sheets

(56) References Cited

U.S. PATENT DOCUMENTS 5,083,800 A 1/1992 Lockton
5,179,517 A 1/1993 Sarbin et al.
5,199,710 A 4/1993 Lamle
5,258,837 A 11/1993 Gormley
5,275,400 A 1/1994 Weingardt et al.
5,321,241 A 6/1994 Craine
5,324,035 A 6/1994 Morris et al.
5,326,104 A 7/1994 Pease et al.
5,386,103 A 1/1995 DeBan et al.
5,398,932 A 3/1995 Eberhardt et al.
5,413,353 A 5/1995 Demarest et al.
5,472,194 A 12/1995 Breeding et al.
5,493,613 A 2/1996 Denno et al.
5,505,449 A 4/1996 Eberhardt et al.
5,507,489 A 4/1996 Reibel et al.
5,562,284 A 10/1996 Stevens
5,580,311 A 12/1996 Haste, III
5,603,502 A 2/1997 Nakagawa
5,605,334 A 2/1997 McCrea, Jr.
5,605,506 A 2/1997 Hoorn et al.
5,613,680 A 3/1997 Groves et al.
5,613,912 A 3/1997 Slater
5,643,086 A 7/1997 Alcorn et al.
5,655,961 A 8/1997 Acres et al.
5,707,286 A 1/1998 Carlson
5,707,287 A 1/1998 McCrea, Jr.
5,737,418 A 4/1998 Saffari et al.
5,741,183 A 4/1998 Acres et al.
5,745,110 A 4/1998 Ertemalp
5,759,102 A 6/1998 Pease et al.
5,770,533 A 6/1998 Franchi
RE35,864 E 7/1998 Weingardt
5,779,545 A 7/1998 Berg et al.
5,800,268 A 9/1998 Molnick
5,813,912 A 9/1998 Shultz
5,823,879 A 10/1998 Goldberg et al.
5,830,067 A 11/1998 Graves et al.
5,830,068 A 11/1998 Brenner et al.
5,830,069 A 11/1998 Soltesz et al.
5,848,426 A 12/1998 Wang et al.
5,850,447 A 12/1998 Peyret
5,851,149 A 12/1998 Xidos et al.
5,890,963 A 4/1999 Yen
5,895,451 A 4/1999 Yamade et al.
5,905,847 A 5/1999 Kobayashi et al.
5,911,626 A 6/1999 McCrea, Jr.
5,957,776 A 9/1999 Hoehne
5,971,851 A 10/1999 Pascal et al.
5,974,135 A 10/1999 Breneman et al.
5,999,808 A 12/1999 LaDue
6,001,016 A 12/1999 Walker et al.
6,042,150 A 3/2000 Daley
6,047,322 A 4/2000 Vaid et al.
6,068,553 A 5/2000 Parker
6,077,161 A 6/2000 Wisler
6,080,063 A 6/2000 Khosla
6,089,980 A 7/2000 Gauselmann
6,093,103 A 7/2000 McCrea, Jr.
6,102,799 A 8/2000 Stupak
6,104,815 A 8/2000 Alcorn et al.
6,106,396 A 8/2000 Alcorn et al.
6,110,041 A 8/2000 Walker et al.
6,110,043 A 8/2000 Olsen
6,117,012 A 9/2000 McCrea, Jr.
6,135,887 A 10/2000 Pease et al.
6,142,872 A * 11/2000 Walker et al. ..... 463/16
6,146,273 A 11/2000 Olsen
6,149,522 A 11/2000 Alcorn et al.
6,152,824 A 11/2000 Rothschild et al.
6,165,069 A 12/2000 Sines et al.
6,166,763 A 12/2000 Rhodes et al.
6,168,523 B1 1/2001 Piechowiak et al.
6,183,366 B1 2/2001 Goldberg et al.
6,185,184 B1 2/2001 Mattaway et al.
6,186,892 B1 2/2001 Frank et al.
6,210,274 B1 4/2001 Carlson
6,210,277 B1 4/2001 Stefan
6,217,447 B1 4/2001 Lofink et al.
6,219,836 B1 4/2001 Wells et al.
6,234,898 B1 5/2001 Belamant et al.
6,244,958 B1 6/2001 Acres
6,251,014 B1 6/2001 Stockdale et al.
6,254,483 B1 7/2001 Acres
6,254,484 B1 7/2001 McCrea, Jr.
6,256,651 B1 7/2001 Tuli
6,264,561 B1 7/2001 Saffari et al.
6,272,223 B1 8/2001 Carlson
6,275,586 B1 8/2001 Kelly
6,279,910 B1 8/2001 de Keller
6,287,202 B1 9/2001 Pascal et al.
6,302,793 B1 10/2001 Fertitta, III et al.
6,312,332 B1 11/2001 Walker et al.
6,319,125 B1 11/2001 Acres
6,325,375 B1 12/2001 Potter et al.
6,336,859 B2 1/2002 Jones et al.
6,346,044 B1 2/2002 McCrea, Jr.
6,362,836 B1 3/2002 Shaw et al.
6,363,509 B1 3/2002 Parulkar et al.
6,380,953 B1 4/2002 Mizuno
6,383,076 B1 5/2002 Tiedeken
6,389,126 B1 5/2002 Bjornberg et al.
6,394,900 B1 5/2002 McGlone et al.
6,400,272 B1 6/2002 Holtzman et al.
6,401,099 B1 6/2002 Koppolu et al.
6,409,602 B1 6/2002 Wiltshire et al.
6,439,996 B2 8/2002 LeMay et al.
6,443,839 B2 9/2002 Stockdale et al.
6,459,882 B1 10/2002 Palermo et al.
6,460,848 B1 10/2002 Soltys et al.
6,464,584 B2 10/2002 Oliver
6,488,581 B1 12/2002 Stockdale
6,488,585 B1 12/2002 Wells et al.
6,490,285 B2 12/2002 Lee et al.
6,503,147 B1 1/2003 Stockdale et al.
6,505,772 B1 1/2003 Mollett et al.
6,508,709 B1 1/2003 Karmarkar
6,508,710 B1 1/2003 Paravia et al.
6,516,350 B1 2/2003 Lumelsky et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,527,638 B1 3/2003 Walker et al.
6,530,836 B2 3/2003 Soltys et al.
6,530,837 B2 3/2003 Soltys et al.
6,533,276 B2 3/2003 Soltys et al.
6,533,658 B1 3/2003 Walker et al.
6,533,662 B2 3/2003 Soltys et al.
6,575,833 B1 6/2003 Stockdale
6,578,847 B1 6/2003 Hedrick et al.
6,579,180 B2 6/2003 Soltys et al.
6,579,181 B2 6/2003 Soltys et al.
6,581,747 B1 6/2003 Charlier et al.
6,595,857 B2 7/2003 Soltys et al.
6,607,441 B1 8/2003 Acres
6,609,978 B1 8/2003 Paulsen
6,612,928 B1 9/2003 Bradford et al.
6,629,184 B1 9/2003 Berg et al.
6,638,170 B1 10/2003 Crumby
6,641,484 B2 11/2003 Oles et al.
6,645,077 B2 11/2003 Rowe
6,652,378 B2 11/2003 Cannon et al.
6,656,048 B2 12/2003 Olsen
6,663,490 B2 12/2003 Soltys et al.
6,675,152 B1 1/2004 Prasad et al.
6,676,522 B2 1/2004 Rowe et al.
6,682,421 B1 1/2004 Rowe et al.
6,682,423 B2 1/2004 Brosnan et al.
6,685,564 B2 2/2004 Oliver
6,685,567 B2 2/2004 Cockerille et al.
6,688,979 B2 2/2004 Soltys et al.
6,699,128 B1 3/2004 Beadell et al.
6,702,291 B2 3/2004 Grebler et al.
6,712,695 B2 3/2004 Mothwurf et al.

(56) References Cited

U.S. PATENT DOCUMENTS 6,712,696 B2 3/2004 Soltys et al.
6,712,702 B2 3/2004 Goldberg et al.
6,718,361 B1 4/2004 Basani et al.
6,722,985 B2 4/2004 Criss-Puszkiewicz et al.
6,728,740 B2 4/2004 Kelly et al.
6,743,102 B1 6/2004 Fiechter et al.
6,746,330 B2 6/2004 Cannon
6,749,510 B2 6/2004 Giobbi
6,752,312 B1 6/2004 Chamberlain et al.
6,755,741 B1 6/2004 Rafaeli
6,758,751 B2 7/2004 Soltys et al.
6,795,858 B1 9/2004 Jain et al.
6,800,029 B2 10/2004 Rowe et al.
6,811,488 B2 11/2004 Paravia et al.
6,817,948 B2 11/2004 Pascal et al.
6,823,419 B2 11/2004 Berg et al.
6,837,789 B2 1/2005 Garahi et al.
6,846,238 B2 1/2005 Wells
6,848,994 B1 2/2005 Knust et al.
6,854,085 B1 2/2005 Morse
6,866,581 B2 3/2005 Martinek et al.
6,866,586 B2 3/2005 Oberberger et al.
6,877,107 B2 4/2005 Giotta et al.
6,884,170 B2 4/2005 Rowe
6,884,173 B2 4/2005 Gauselmann
6,884,174 B2 4/2005 Lundy et al.
6,896,618 B2 5/2005 Benoy et al.
6,899,627 B2 5/2005 Lam et al.
6,899,628 B2 5/2005 Leen et al.
6,901,440 B1 5/2005 Bimm et al.
6,905,411 B2 6/2005 Nguyen et al.
6,908,387 B2 6/2005 Hedrick et al.
6,962,530 B2 11/2005 Jackson
6,971,956 B2 12/2005 Rowe et al.
6,972,682 B2 12/2005 Lareau et al.
6,993,587 B1 1/2006 Basani et al.
6,997,803 B2 2/2006 LeMay et al.
7,013,469 B2 3/2006 Smith et al.
7,025,674 B2 4/2006 Adams et al.
7,027,996 B2 4/2006 Levinson
7,035,626 B1 4/2006 Luciano, Jr.
7,050,056 B2 5/2006 Meyringer
7,051,101 B1 5/2006 Dubrovsky et al.
7,062,470 B2 6/2006 Prasad et al.
7,086,947 B2 8/2006 Walker et al.
7,099,035 B2 8/2006 Brooks et al.
7,100,184 B1 8/2006 Kahn
7,112,138 B2 9/2006 Hedrick et al.
7,114,718 B2 10/2006 Grauzer et al.
7,116,782 B2 10/2006 Jackson et al.
7,120,879 B2 10/2006 Gutberlet et al.
7,128,652 B1 10/2006 Lavoie et al.
7,140,964 B2 11/2006 Walker et al.
7,147,558 B2 12/2006 Giobbi
7,168,089 B2 1/2007 Nguyen et al.
7,179,170 B2 2/2007 Martinek et al.
7,186,181 B2 3/2007 Rowe
7,189,161 B1 3/2007 Wiltshire et al.
7,197,765 B2 3/2007 Chan et al.
7,198,571 B2 4/2007 LeMay et al.
7,203,841 B2 4/2007 Jackson et al.
RE39,644 E 5/2007 Alcorn et al.
7,246,799 B2 7/2007 Snow
7,260,834 B1 8/2007 Carlson
7,291,068 B2 11/2007 Bryant et al.
7,293,282 B2 11/2007 Danforth et al.
7,297,062 B2 11/2007 Gatto et al.
7,300,352 B2 11/2007 Rowe
7,303,473 B2 12/2007 Rowe
7,303,475 B2 12/2007 Britt et al.
7,309,065 B2 12/2007 Yoseloff et al.
7,311,605 B2 12/2007 Moser
7,329,185 B2 2/2008 Conover et al.
7,330,822 B1 2/2008 Robson et al.
7,331,520 B2 2/2008 Silva et al.
7,337,330 B2 2/2008 Gatto et al.
7,346,682 B2 3/2008 Basani et al.
7,349,920 B1 3/2008 Feinberg et al.
7,351,147 B2 4/2008 Stockdale et al.
7,353,183 B1 4/2008 Musso
7,356,770 B1 4/2008 Jackson
7,363,342 B1 4/2008 Wang et al.
7,364,510 B2 4/2008 Walker et al.
7,370,282 B2 5/2008 Cary
7,384,339 B2 6/2008 LeMay et al.
7,398,327 B2 7/2008 Lee
7,410,422 B2 8/2008 Fine
7,419,428 B2 9/2008 Rowe
7,427,233 B2 9/2008 Walker et al.
7,427,236 B2 9/2008 Kaminkow et al.
7,434,805 B2 10/2008 Grauzer et al.
7,435,179 B1 10/2008 Ford
7,438,221 B2 10/2008 Washington et al.
7,438,295 B2 10/2008 Aida
7,438,643 B2 * 10/2008 Brosnan ..... G07F 17/32 455/420
7,455,591 B2 11/2008 Nguyen
7,460,863 B2 12/2008 Steelberg et al.
7,465,231 B2 12/2008 Lewin et al.
7,473,178 B2 1/2009 Boyd et al.
7,483,394 B2 1/2009 Chang et al.
7,484,207 B2 1/2009 Sato
7,500,915 B2 3/2009 Wolf et al.
7,510,474 B2 3/2009 Carter, Sr.
7,510,478 B2 3/2009 Benbrahim et al.
7,515,718 B2 4/2009 Nguyen et al.
7,516,959 B2 4/2009 Huard et al.
7,534,169 B2 5/2009 Amaitis et al.
7,537,456 B2 5/2009 Snow
7,549,576 B2 6/2009 Alderucci et al.
7,559,080 B2 7/2009 Bhargavan et al.
7,566,274 B2 7/2009 Johnson et al.
7,575,234 B2 8/2009 Soltys et al.
7,577,847 B2 8/2009 Nguyen et al.
7,578,739 B2 8/2009 Gauselmann
7,581,256 B2 8/2009 Cockerille et al.
7,585,217 B2 9/2009 Lutnick et al.
7,594,030 B2 9/2009 Teodosiu et al.
7,607,976 B2 10/2009 Baerlocher et al.
7,607,977 B2 10/2009 Baerlocher et al.
7,610,549 B2 10/2009 Vignet
7,611,404 B1 11/2009 Hilf et al.
7,611,407 B1 11/2009 Itkis et al.
7,611,409 B2 11/2009 Muir et al.
7,617,151 B2 11/2009 Rowe
7,618,317 B2 11/2009 Jackson
7,621,809 B2 11/2009 Baerlocher et al.
7,629,886 B2 12/2009 Steeves
7,634,550 B2 12/2009 Wolber et al.
7,637,810 B2 12/2009 Amaitis et al.
7,644,861 B2 1/2010 Alderucci et al.
7,648,414 B2 1/2010 McNutt et al.
7,666,081 B2 2/2010 Baerlocher et al.
7,666,095 B2 2/2010 Van Luchene
7,674,179 B2 3/2010 Baerlocher et al.
7,682,249 B2 3/2010 Winans et al.
7,684,874 B2 3/2010 Schlottmann et al.
7,684,882 B2 3/2010 Baerlocher et al.
7,685,516 B2 3/2010 Fischer
7,685,593 B2 3/2010 Solomon et al.
7,686,688 B2 3/2010 Friedman et al.
7,688,322 B2 3/2010 Kapler et al.
7,689,302 B2 3/2010 Schlottmann et al.
7,690,995 B2 4/2010 Frankulin et al.
7,699,697 B2 4/2010 Darrah et al.
7,699,703 B2 4/2010 Muir et al.
7,702,719 B1 4/2010 Betz et al.
7,706,895 B2 4/2010 Callaghan
7,712,050 B2 5/2010 Gutberlet et al.
7,722,453 B2 5/2010 Lark et al.
7,730,198 B2 6/2010 Ruppert et al.
7,744,452 B2 6/2010 Cimring et al.
7,744,462 B2 6/2010 Grav et al.
7,747,741 B2 6/2010 Basani et al.

(56) References Cited

U.S. PATENT DOCUMENTS 7,753,790 B2 7/2010 Nguyen et al.
7,769,877 B2 8/2010 McBride et al.
7,778,635 B2 8/2010 Crookham et al.
7,780,525 B2 8/2010 Walker et al.
7,780,526 B2 8/2010 Nguyen et al.
7,780,529 B2 8/2010 Rowe et al.
7,783,881 B2 8/2010 Morrow et al.
7,785,204 B2 8/2010 Wells et al.
7,787,972 B2 8/2010 Schlottmann et al.
7,788,503 B2 8/2010 Gatto et al.
7,794,319 B2 9/2010 Luciano, Jr. et al.
7,805,719 B2 9/2010 O'Neill
7,824,255 B2 11/2010 Lutnick et al.
7,824,267 B2 11/2010 Cannon et al.
7,828,649 B2 11/2010 Cuddy et al.
7,828,661 B1 11/2010 Fish et al.
7,841,946 B2 11/2010 Walker et al.
7,844,944 B2 11/2010 Gutberlet et al.
7,846,018 B2 12/2010 Baerlocher
7,846,020 B2 12/2010 Walker et al.
7,850,528 B2 12/2010 Wells
7,857,702 B2 12/2010 Hilbert
7,862,425 B2 1/2011 Cavagna
7,867,081 B2 1/2011 Schneider et al.
7,867,091 B2 1/2011 Moshal
7,871,323 B2 1/2011 Walker et al.
7,874,920 B2 1/2011 Hornik et al.
7,874,921 B2 1/2011 Baszucki et al.
7,886,288 B2 2/2011 Breckner et al.
7,892,093 B2 2/2011 Kniesteadt et al.
7,898,679 B2 3/2011 Brack et al.
7,901,294 B2 3/2011 Walker et al.
7,905,770 B2 3/2011 Snow
7,905,780 B2 3/2011 Morrow et al.
7,908,486 B2 3/2011 Gatto et al.
7,909,689 B2 3/2011 Lardie
7,918,735 B2 4/2011 Inamura
7,921,026 B2 4/2011 O'Cull et al.
7,921,405 B2 4/2011 Gupta et al.
7,931,533 B2 4/2011 LeMay et al.
7,937,464 B2 5/2011 Ruppert et al.
7,946,911 B2 5/2011 Vang et al.
7,963,847 B2 6/2011 Baerlocher
7,980,954 B2 7/2011 Gagner et al.
7,988,554 B2 8/2011 LeMay et al.
7,993,199 B2 8/2011 Iddings et al.
8,025,574 B2 9/2011 Hilbert
8,028,046 B2 9/2011 Elliott et al.
8,033,913 B2 10/2011 Cockerille et al.
8,037,313 B2 10/2011 Hamalainen et al.
8,051,180 B2 11/2011 Mazzaferri et al.
8,057,294 B2 11/2011 Pacey et al.
8,057,297 B2 11/2011 Silvestro
8,062,134 B2 11/2011 Kelly et al.
8,070,583 B2 12/2011 Baerlocher et al.
8,073,657 B2 12/2011 Moore, III et al.
8,075,403 B2 12/2011 O'Brien et al.
8,092,289 B2 1/2012 Mai
8,092,307 B2 1/2012 Kelly
8,092,309 B2 1/2012 Bickley
8,100,753 B2 1/2012 Soltys
8,117,461 B2 2/2012 Bigelow, Jr. et al.
8,135,793 B2 3/2012 Ruppert et al.
8,147,316 B2 4/2012 Arezina et al.
8,147,334 B2 4/2012 Gatto et al.
8,171,155 B2 5/2012 Ruppert
8,172,661 B1 5/2012 Hein
8,177,634 B2 5/2012 Herrmann et al.
8,182,346 B2 5/2012 Herrmann et al.
8,185,423 B2 5/2012 Brook et al.
8,187,087 B2 5/2012 Herrmann et al.
8,187,101 B2 5/2012 Herrmann et al.
8,192,283 B2 6/2012 Ruppert et al.
8,192,289 B2 6/2012 Herrmann et al.
8,195,825 B2 6/2012 Ruppert et al.
8,195,826 B2 6/2012 Ruppert et al.
8,197,340 B2 6/2012 Garvey et al.
8,197,344 B2 6/2012 Rathsack et al.
8,201,229 B2 6/2012 Ruppert et al.
8,241,111 B2 8/2012 Manfredi et al.
8,246,466 B2 8/2012 Herrmann et al.
8,266,213 B2 9/2012 Crowder
8,272,945 B2 9/2012 Kelly et al.
8,277,324 B2 10/2012 Herrmann et al.
8,280,777 B2 10/2012 Mengerink et al.
8,285,740 B2 10/2012 Graham et al.
8,308,554 B2 11/2012 Rowe et al.
8,360,870 B2 1/2013 Herrmann et al.
8,366,550 B2 2/2013 Herrmann et al.
8,512,150 B2 8/2013 Herrmann et al.
8,626,878 B2 1/2014 Wolber et al.
8,628,422 B2 1/2014 Allen et al.
8,974,305 B2 3/2015 Costello et al.
2001/0019966 A1 9/2001 Idaka
2001/0044337 A1 11/2001 Rowe et al.
2002/0004824 A1 1/2002 Cuan et al.
2002/0049909 A1* 4/2002 Jackson et al. ..... 713/188
2002/0111213 A1 8/2002 McEntee et al.
2002/0113371 A1 8/2002 Snow
2002/0115487 A1 8/2002 Wells
2002/0119824 A1 8/2002 Allen
2002/0142844 A1 10/2002 Kerr
2002/0144115 A1 10/2002 Lemay et al.
2002/0147047 A1 10/2002 Letovsky et al.
2002/0151363 A1 10/2002 Letovsky et al.
2002/0152120 A1 10/2002 Howington
2003/0004871 A1 1/2003 Rowe
2003/0032474 A1 2/2003 Kaminkow
2003/0042679 A1 3/2003 Snow
2003/0064798 A1 4/2003 Grauzer et al.
2003/0075869 A1 4/2003 Breeding et al.
2003/0090064 A1 5/2003 Hoyt et al.
2003/0104865 A1 6/2003 Itkis et al.
2003/0130024 A1 7/2003 Darby
2003/0134675 A1 7/2003 Oberberger
2003/0182414 A1 9/2003 O'Neill
2003/0185229 A1 10/2003 Shachar et al.
2003/0203755 A1 10/2003 Jackson
2003/0206548 A1 11/2003 Bannai et al.
2003/0224858 A1 12/2003 Yoseloff et al.
2003/0228912 A1 12/2003 Wells et al.
2003/0232651 A1 12/2003 Huard et al.
2004/0002386 A1 1/2004 Wolfe et al.
2004/0002388 A1 1/2004 Larsen et al.
2004/0023712 A1 2/2004 Oliver
2004/0029635 A1 2/2004 Giobbi
2004/0043815 A1 3/2004 Kaminkow
2004/0043820 A1 3/2004 Schlottmann
2004/0048669 A1 3/2004 Rowe
2004/0048671 A1 3/2004 Rowe
2004/0064817 A1 4/2004 Shibayama et al.
2004/0082385 A1 4/2004 Silva et al.
2004/0092310 A1 5/2004 Brosnan et al.
2004/0098579 A1 5/2004 Nakano et al.
2004/0106452 A1 6/2004 Nguyen et al.
2004/0110119 A1 6/2004 Riconda et al.
2004/0127291 A1 7/2004 George et al.
2004/0133485 A1 7/2004 Schoonmaker et al.
2004/0142744 A1 7/2004 Atkinson et al.
2004/0166940 A1 8/2004 Rothschild
2004/0180721 A1 9/2004 Rowe
2004/0180722 A1 9/2004 Giobbi
2004/0185936 A1 9/2004 Block et al.
2004/0204231 A1* 10/2004 Martin et al. ..... 463/25
2004/0229684 A1 11/2004 Blackburn et al.
2004/0254993 A1 12/2004 Mamas
2004/0259640 A1 12/2004 Gentles et al.
2005/0032564 A1 2/2005 Sines
2005/0043094 A1 2/2005 Nguyen et al.
2005/0054438 A1 3/2005 Rothschild et al.
2005/0070358 A1 3/2005 Angell et al.
2005/0080898 A1 4/2005 Block
2005/0119052 A1 6/2005 Russell et al.
2005/0143166 A1 6/2005 Walker et al.

(56) References Cited

U.S. PATENT DOCUMENTS

2005/0153778 A1 7/2005 Nelson et al.
2005/0164762 A1 7/2005 Smith et al.
2005/0171808 A1 8/2005 Saenz et al.
2005/0192092 A1 9/2005 Breckner et al.
2005/0222891 A1 10/2005 Chan et al.
2005/0239542 A1 10/2005 Olsen
2006/0003828 A1 1/2006 Abecassis
2006/0004618 A1 1/2006 Brixius
2006/0009282 A1 1/2006 George et al.
2006/0015716 A1 1/2006 Thornton et al.
2006/0026499 A1 2/2006 Weddle
2006/0031763 A1 2/2006 Yeung
2006/0035707 A1 2/2006 Nguyen et al.
2006/0040745 A1 2/2006 Wells et al.
2006/0046849 A1 3/2006 Kovacs
2006/0052169 A1 3/2006 Britt et al.
2006/0068899 A1 3/2006 White et al.
2006/0080175 A1 4/2006 Rowe et al.
2006/0116208 A1 6/2006 Chen et al.
2006/0121970 A1 6/2006 Khal
2006/0172804 A1 8/2006 Acres et al.
2006/0183541 A1 8/2006 Okada et al.
2006/0189381 A1 8/2006 Daniel et al.
2006/0195847 A1 8/2006 Amano et al.
2006/0205508 A1 9/2006 Green
2006/0217202 A1 9/2006 Burke et al.
2006/0247013 A1 11/2006 Walker et al.
2006/0247057 A1 11/2006 Green et al.
2006/0252530 A1 11/2006 Oberberger et al.
2006/0253702 A1 11/2006 Lowell et al.
2006/0259604 A1 11/2006 Kotchavi et al.
2006/0277487 A1 12/2006 Poulsen et al.
2006/0284376 A1 12/2006 Snow
2006/0287098 A1 12/2006 Morrow et al.
2007/0004501 A1 1/2007 Brewer et al.
2007/0015583 A1 1/2007 Tran
2007/0026923 A1 2/2007 Muir
2007/0026935 A1 2/2007 Wolf et al.
2007/0026942 A1 2/2007 Kinsley et al.
2007/0032288 A1 2/2007 Nelson et al.
2007/0033247 A1 2/2007 Martin
2007/0054740 A1 3/2007 Salls et al.
2007/0055753 A1 3/2007 Robb
2007/0057453 A1 3/2007 Soltys et al.
2007/0057454 A1 3/2007 Fleckenstein
2007/0057469 A1 3/2007 Grauzer et al.
2007/0060225 A1 3/2007 Hosogai et al.
2007/0060259 A1 3/2007 Pececnik
2007/0060307 A1 3/2007 Mathis et al.
2007/0060320 A1 3/2007 Kelly et al.
2007/0060354 A1 3/2007 Themer et al.
2007/0060365 A1 3/2007 Tien et al.
2007/0072677 A1 3/2007 Lavoie et al.
2007/0077995 A1 4/2007 Oak et al.
2007/0093298 A1 4/2007 Brunet
2007/0105628 A1 5/2007 Arbogast et al.
2007/0111775 A1 5/2007 Yoseloff
2007/0111786 A1 5/2007 Snow
2007/0111791 A1 5/2007 Arbogast et al.
2007/0111794 A1 5/2007 Hogan et al.
2007/0117608 A1* 5/2007 Roper ..... G07F 17/32 463/16
2007/0118844 A1 5/2007 Huang et al.
2007/0123346 A1 5/2007 Perez et al.
2007/0124483 A1 5/2007 Marples et al.
2007/0129141 A1 6/2007 Walker et al.
2007/0129145 A1 6/2007 Blackburn et al.
2007/0139683 A1 6/2007 Wegeng et al.
2007/0155490 A1 7/2007 Phillips et al.
2007/0167235 A1 7/2007 Naicker
2007/0173331 A1 7/2007 Crawford, III et al.
2007/0184905 A1 8/2007 Gatto et al.
2007/0191102 A1 8/2007 Coliz et al.
2007/0192748 A1 8/2007 Martin et al.
2007/0197294 A1 8/2007 Gong
2007/0197298 A1 8/2007 Rowe
2007/0198418 A1 8/2007 MacDonald et al.
2007/0202941 A1 8/2007 Miltenberger et al.
2007/0208816 A1 9/2007 Baldwin et al.
2007/0213116 A1 9/2007 Crawford et al.
2007/0214030 A1 9/2007 Shear et al.
2007/0214058 A1 9/2007 Rouhi
2007/0218998 A1 9/2007 Arbogast et al.
2007/0225061 A1 9/2007 Naobayashi
2007/0235521 A1 10/2007 Mateen et al.
2007/0238526 A1 10/2007 Chandranmenon
2007/0241497 A1 10/2007 Soltys et al.
2007/0241498 A1 10/2007 Soltys
2007/0243925 A1 10/2007 LeMay et al.
2007/0243927 A1 10/2007 Soltys
2007/0243935 A1 10/2007 Huizinga
2007/0259709 A1 11/2007 Kelly et al.
2007/0259711 A1 11/2007 Thomas
2007/0265092 A1 11/2007 Betteridge
2007/0298868 A1 12/2007 Soltys
2008/0004108 A1 1/2008 Klinkhammer
2008/0009344 A1 1/2008 Graham et al.
2008/0026832 A1 1/2008 Stevens et al.
2008/0026848 A1 1/2008 Byng
2008/0032763 A1 2/2008 Giobbi
2008/0038035 A1 2/2008 Shuldman et al.
2008/0039192 A1 2/2008 Laut
2008/0039208 A1 2/2008 Abrink et al.
2008/0045341 A1 2/2008 Englman
2008/0045342 A1 2/2008 Crowder et al.
2008/0058105 A1 3/2008 Combs et al.
2008/0064501 A1 3/2008 Patel
2008/0065590 A1 3/2008 Castro et al.
2008/0073840 A1 3/2008 Comeau
2008/0076572 A1 3/2008 Nguyen et al.
2008/0090651 A1 4/2008 Baerlocher
2008/0091490 A1 4/2008 Abrahams et al.
2008/0096656 A1 4/2008 LeMay et al.
2008/0096659 A1 4/2008 Kreloff et al.
2008/0102919 A1 5/2008 Rowe et al.
2008/0102932 A1 5/2008 Anderson et al.
2008/0108405 A1 5/2008 Brosnan et al.
2008/0108433 A1 5/2008 DiMichele et al.
2008/0113764 A1 5/2008 Soltys
2008/0113771 A1 5/2008 Baerlocher et al.
2008/0113772 A1 5/2008 Burrill et al.
2008/0113773 A1 5/2008 Johnson et al.
2008/0119284 A1 5/2008 Luciano, Jr. et al.
2008/0126803 A1 5/2008 Ginter et al.
2008/0127174 A1 5/2008 Johnson
2008/0136102 A1 6/2008 Hoover
2008/0138773 A1 6/2008 Lathrop
2008/0146337 A1 6/2008 Halonen et al.
2008/0153599 A1 6/2008 Atashband
2008/0153600 A1 6/2008 Swarna
2008/0154916 A1 6/2008 Atashband
2008/0155665 A1 6/2008 Ruppert
2008/0162729 A1 7/2008 Ruppert
2008/0165771 A1 7/2008 Gainey et al.
2008/0171588 A1 7/2008 Atashband
2008/0171598 A1 7/2008 Deng
2008/0171602 A1 7/2008 Patel et al.
2008/0176627 A1 7/2008 Lardie
2008/0200255 A1 8/2008 Eisele
2008/0243697 A1 10/2008 Irving et al.
2008/0244565 A1 10/2008 Levidow et al.
2008/0248875 A1 10/2008 Beatty
2008/0252011 A1 10/2008 Bickley et al.
2008/0261699 A1 10/2008 Topham et al.
2008/0261701 A1 10/2008 Lewin et al.
2008/0268934 A1 10/2008 Mattice et al.
2008/0287197 A1 11/2008 Ruppert et al.
2008/0293494 A1 11/2008 Adiraju et al.
2008/0300046 A1 12/2008 Gagner et al.
2008/0311971 A1 12/2008 Dean
2008/0313282 A1 12/2008 Warila et al.
2008/0318655 A1 12/2008 Davies
2008/0318685 A9 12/2008 Oak et al.
2008/0318686 A1 12/2008 Crowder, Jr. et al.

(56) References Cited

U.S. PATENT DOCUMENTS

| | | | | |
|---|---|---|---|---|
| 2009/0005176 | A1 | 1/2009 | Morrow et al. | |
| 2009/0005177 | A1 | 1/2009 | Kishi et al. | |
| 2009/0011833 | A1 | 1/2009 | Seelig et al. | |
| 2009/0054139 | A1 | 2/2009 | Anderson | |
| 2009/0063309 | A1 | 3/2009 | Stephens | |
| 2009/0069090 | A1 | 3/2009 | Moser et al. | |
| 2009/0100409 | A1 | 4/2009 | Toneguzzo | |
| 2009/0115133 | A1 | 5/2009 | Kelly et al. | |
| 2009/0118001 | A1 | 5/2009 | Kelly et al. | |
| 2009/0118005 | A1 | 5/2009 | Kelly et al. | |
| 2009/0118006 | A1 | 5/2009 | Kelly et al. | |
| 2009/0121434 | A1 | 5/2009 | Baerlocher et al. | |
| 2009/0124329 | A1 | 5/2009 | Palmisano | |
| 2009/0124350 | A1 | 5/2009 | Iddings et al. | |
| 2009/0124385 | A1* | 5/2009 | Cuddy et al. | 463/42 |
| 2009/0124392 | A1 | 5/2009 | Ruppert et al. | |
| 2009/0124394 | A1 | 5/2009 | Swarna | |
| 2009/0125603 | A1 | 5/2009 | Atashband et al. | |
| 2009/0131134 | A1 | 5/2009 | Baerlocher et al. | |
| 2009/0131144 | A1 | 5/2009 | Allen | |
| 2009/0131163 | A1 | 5/2009 | Arbogast et al. | |
| 2009/0132720 | A1 | 5/2009 | Ruppert et al. | |
| 2009/0156310 | A1 | 6/2009 | Fargo | |
| 2009/0156313 | A1 | 6/2009 | Blackburn et al. | |
| 2009/0170594 | A1 | 7/2009 | Delaney et al. | |
| 2009/0176568 | A1 | 7/2009 | Reddy et al. | |
| 2009/0176578 | A1 | 7/2009 | Herrmann et al. | |
| 2009/0181776 | A1 | 7/2009 | Deng | |
| 2009/0189351 | A1 | 7/2009 | Baerlocher et al. | |
| 2009/0197676 | A1 | 8/2009 | Baerlocher et al. | |
| 2009/0239667 | A1 | 9/2009 | Rowe et al. | |
| 2009/0270170 | A1 | 10/2009 | Patton | |
| 2009/0275394 | A1 | 11/2009 | Young et al. | |
| 2009/0275400 | A1 | 11/2009 | Rehm et al. | |
| 2009/0275401 | A1 | 11/2009 | Allen et al. | |
| 2009/0275402 | A1 | 11/2009 | Backover et al. | |
| 2009/0276341 | A1 | 11/2009 | McMahan et al. | |
| 2009/0298575 | A1 | 12/2009 | Hopkins et al. | |
| 2009/0298577 | A1 | 12/2009 | Gagner et al. | |
| 2009/0298583 | A1 | 12/2009 | Jones | |
| 2009/0307069 | A1 | 12/2009 | Meyerhofer | |
| 2009/0315264 | A1 | 12/2009 | Snow et al. | |
| 2009/0325708 | A9 | 12/2009 | Kerr | |
| 2009/0325716 | A1 | 12/2009 | Harari | |
| 2010/0016050 | A1 | 1/2010 | Snow et al. | |
| 2010/0016067 | A1 | 1/2010 | White et al. | |
| 2010/0016068 | A1 | 1/2010 | White et al. | |
| 2010/0022299 | A1 | 1/2010 | Ryan | |
| 2010/0048291 | A1 | 2/2010 | Warkentin | |
| 2010/0048304 | A1 | 2/2010 | Boesen | |
| 2010/0058320 | A1 | 3/2010 | Milligan et al. | |
| 2010/0062835 | A1 | 3/2010 | Hopkins | |
| 2010/0062838 | A1 | 3/2010 | Nguyen et al. | |
| 2010/0069155 | A1 | 3/2010 | Schwartz et al. | |
| 2010/0093440 | A1 | 4/2010 | Burke | |
| 2010/0093441 | A1 | 4/2010 | Rajaraman et al. | |
| 2010/0125851 | A1 | 5/2010 | Singh et al. | |
| 2010/0131772 | A1 | 5/2010 | Atashband et al. | |
| 2010/0178987 | A1 | 7/2010 | Pacey | |
| 2010/0197410 | A1 | 8/2010 | Leen et al. | |
| 2010/0210353 | A1 | 8/2010 | Gagner et al. | |
| 2010/0234110 | A1 | 9/2010 | Clarkson | |
| 2010/0240440 | A1 | 9/2010 | Szrek et al. | |
| 2010/0255899 | A1 | 10/2010 | Paulsen | |
| 2011/0009184 | A1 | 1/2011 | Byng | |
| 2011/0059800 | A1 | 3/2011 | Anderson et al. | |
| 2011/0074107 | A1* | 3/2011 | Rowe | 273/292 |
| 2011/0105208 | A1 | 5/2011 | Bickley | |
| 2011/0111826 | A1 | 5/2011 | Baerlocher et al. | |
| 2011/0124417 | A1 | 5/2011 | Baynes et al. | |
| 2011/0130190 | A1 | 6/2011 | Hamman et al. | |
| 2011/0159952 | A1 | 6/2011 | Kerr | |
| 2011/0159953 | A1 | 6/2011 | Kerr | |
| 2011/0165936 | A1 | 7/2011 | Kerr | |
| 2011/0172008 | A1 | 7/2011 | Alderucci | |
| 2011/0179409 | A1 | 7/2011 | Yoseloff et al. | |
| 2011/0183748 | A1 | 7/2011 | Wilson et al. | |
| 2011/0230268 | A1 | 9/2011 | Williams | |
| 2011/0269529 | A1 | 11/2011 | Baerlocher | |
| 2011/0269534 | A1 | 11/2011 | Kelly et al. | |
| 2011/0275430 | A1 | 11/2011 | Walker et al. | |
| 2011/0287829 | A1 | 11/2011 | Clarkson et al. | |
| 2012/0015724 | A1 | 1/2012 | Ocko et al. | |
| 2012/0015725 | A1 | 1/2012 | Ocko et al. | |
| 2012/0015743 | A1 | 1/2012 | Lam et al. | |
| 2012/0015747 | A1 | 1/2012 | Ocko et al. | |
| 2012/0021835 | A1 | 1/2012 | Keller et al. | |
| 2012/0034977 | A1 | 2/2012 | Kammler | |
| 2012/0110649 | A1 | 5/2012 | Murphy | |
| 2012/0115616 | A1 | 5/2012 | Phillips et al. | |
| 2012/0203692 | A1 | 8/2012 | Olliphant et al. | |
| 2012/0295691 | A1 | 11/2012 | Walker | |
| 2013/0053117 | A1 | 2/2013 | Snow | |
| 2013/0184060 | A1 | 7/2013 | Costello et al. | |

FOREIGN PATENT DOCUMENTS

| | | | |
|---|---|---|---|
| CN | 101149856 | A | 3/2008 |
| DE | 19940954 | A1 | 3/2001 |
| EP | 1074955 | A2 | 2/2001 |
| EP | 1463008 | A2 | 9/2004 |
| GB | 2380143 | A | 4/2003 |
| JP | 8255059 | | 10/1996 |
| KR | 2001-0084838 | | 9/2001 |
| KR | 2002-0061793 | | 7/2002 |
| KR | 2003-0091635 | | 12/2003 |
| WO | 02/05914 | A1 | 1/2002 |
| WO | 03/060846 | A2 | 7/2003 |
| WO | 2005/035084 | | 4/2005 |
| WO | 2007/033207 | A2 | 3/2007 |
| WO | 2007047223 | A2 | 4/2007 |
| WO | 2011109454 | | 9/2011 |

OTHER PUBLICATIONS

U.S. Appl. No. 13/609,031, filed Sep. 10, 2012, and titled "Network Gaming Architecture, Gaming Systems, and Related Methods," to Costello et al.

U.S. Appl. No. 13/871,824, filed Apr. 26, 2013, and titled "Distributing Supplemental Pot in Wagering Games Based on Predetermined Event," to Castle et al.

U.S. Appl. No. 13/864,069, filed Apr. 16, 2013, and titled "Administering Wagering Games Having Supplemental Pot," to Louis J. Castle, II.

U.S. Appl. No. 13/353,194, filed Jan. 18, 2012, and titled "Network Gaming Architecture, Gaming Systems, and Related Methods," to Costello et al.

International Search Report and Written Opinion for co-pending application PCT/US13/21959, dated May 10, 2013.

International Search Report and Written Opinion for co-pending application PCT/US13/22153, dated Apr. 8, 2013.

"BOB and LDAP," Gaming Standards Association, Fremont, California, 7 pages, Oct. 26, 2003.

"GSA Point-to-Point SOAP/HTTPS Transport and Security Specification v1.0.3," Gaming Standards Association Transport Technical Committee, 16 pages, Jun. 5, 2007.

Bally Technologies, Inc., iVIEW, http://ballytech.com/systems/product.cfm?id=9, download date Nov. 6, 2007, 2 pages.

Bally TMS, "MP21—Automated Table Tracking/Features," 2 pages, Nov. 2005.

Bally TMS, "MPBacc—Specifications/Specifications," 2 pages, Nov. 2005.

Bally TMS, "MPLite—Table Management System/Features," 2 pages, Nov. 2005.

Bulavsky, J., "Tracking the Tables," Casino Journal, May 2004, pp. 44-47, accessed Dec. 21, 2005, URL = http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

(56) References Cited

OTHER PUBLICATIONS

Costello et al., "Network Gaming Architecture, Gaming Systems, and Related Methods," Office Action dated Mar. 27, 2014, for U.S. Appl. No. 13/609,031, 11 pages.
Costello et al., "Network Gaming Architecture, Gaming Systems, and Related Methods," Amendment dated Jul. 25, 2014, for U.S. Appl. No. 13/609,031, 12 pages.
Costello et al., "Network Gaming Architecture, Gaming Systems, and Related Methods," Notice of Allowance dated Nov. 3, 2014, for U.S. Appl. No. 13/609,031, 7 pages.
Costello et al., "Network Gaming Architecture, Gaming Systems, and Related Methods," Office Action dated Feb. 28, 2014, for U.S. Appl. No. 13/353,194, 15 pages.
Costello et al., "Network Gaming Architecture, Gaming Systems, and Related Methods," Amendment dated Jun. 12, 2014, for U.S. Appl. No. 13/353,194, 4 pages.
Costello et al., "Network Gaming Architecture, Gaming Systems, and Related Methods," Office Action dated Dec. 22, 2014, for U.S. Appl. No. 13/353,194, 7 pages.
Costello et al., "Network Gaming Architecture, Gaming Systems, and Related Methods," Amendment dated Mar. 20, 2015, for U.S. Appl. No. 13/353,194, 8 pages.
Gros, R., "All You Ever Wanted to Know About Table Games," reprinted from *Global Gaming Business*, Aug. 1, 2003, 2 pages.
Gwyddion User Guide, "False Color Mapping: Chapter 3. Getting Started," retrieved from URL=http://sourceforge.net/projects/gwyddion/files/user-guide/2007-06-28/gwyddion-user-guide-xhtm1-2007-06-28.tar.gz/download, retrieved on Nov. 21, 2012, 2 pages.
Hung et al., "Performance Evaluation of the Least Conflict Sharable Spreading Code Assignment Algorithm," IEEE, 1996, 5 pages.
MagTek, "Port Powered Swipe Reader," Technical Reference Manual, Manual Part No. 99875094 Rev 12, Jun. 2003, 20 pages.
Mikohn, "Mikohn Tablelink—the Industry's Premier Table Tracking Solution Delivers Improvements Straight to the Bottom Line," 2 pages, before Jan. 1, 2004.
Olesiejuk, "Discovery Services for Gaming Devices on a Casino Floor," Gaming Standards Association, 3 pages, Mar. 12, 2007.
Requirements document, "Game Authentication Terminal Program (GAT3)," to Gaming Standards Association, Aug. 2005, 27 pages.
Standards document, "Technical Standards for Gaming Devices and On-Line Slot Systems," to Nevada Gaming Commission and State Gaming Control Board, Aug. 17, 2005, 15 pages.
Terdiman, D., "Who's Holding the Aces Now?", reprinted from *Wired News*, Aug. 18, 2003, 2 pages.
Winkler, C., "Product Spotlight: MindPlay," reprinted from *Gaming and Leisure Technology*, Fall 2003, 2 pages.
Australian Examination Report dated Nov. 5, 2015, for corresponding AU Application No. 2013209750, 2 pages.
Costello et al., "Network Gaming Architecture, Gaming Systems, and Related Methods," Notice of Allowance dated Apr. 24, 2015, for U.S. Appl. No. 13/353,194, 6 pages.
Lewis, "The 12 Commandments of File Sharing," Windows IT Pro, Apr. 26, 2004, obtained from http://windowsitpro.com/security/12-commandments-file-sharing on Feb. 27, 2015, 6 pages
Chinese Office Action with English Translation dated Apr. 1, 2016, for corresponding CN application No. 201380014740.4, 8 pages.
Chinese Office Action with English Translation dated May 27, 2016, for corresponding CN application No. 201380014624.2, 41 pages.
European Office Action dated Apr. 4, 2016, for corresponding EP application No. 13738494.7-1657, 5 pages.
PCT Written Opinion of the International Preliminary Examining Authority, PCT Application No. PCT/US2013/021959, dated Jan. 30, 2014, 4 pages.
U.S. Office Action, U.S. Appl. No. 13/609,031, dated Mar. 27, 2014, 11 pages.
U.S. Office Action, U.S. Appl. No. 13/353,194, dated Feb. 28, 2014, 15 pages.

* cited by examiner

PLAY FOR FUN NETWORK GAMING SYSTEM AND METHOD

RELATED APPLICATIONS

This application is a divisional of U.S. patent application Ser. No. 13/609,031 filed Sep. 10, 2012, which is a continuation-in-part of U.S. patent application Ser. No. 13/353,194 filed on Jan. 18, 2012 which are incorporated by reference herein in their entirety.

FIELD

Embodiments of the present disclosure relate generally to wagering games and, more particularly, to network gaming architectures, gaming systems, and related methods.

BACKGROUND

Global internet access has revolutionized electronic gaming, and in particular, participation in on-line gambling games and related websites offering such games. Such internet gaming platforms have enabled players to participate in gambling and other gaming events through personal computers or other electronic devices, wherever the player may be and at all times. Implementations of on-line gambling may include typical gambling elements, such as permitting one or more users to bet against the House in wagering games that are similar to those found in traditional casinos.

Many casinos have an on-line presence and offer on-line gambling operations. Such on-line gambling operations generally enable users to choose a wagering game, enter the wagering game by either downloading a computer application or through a web browser, place bets on one or more possible outcomes of the game, and win or lose money according to the outcome of the bets. With most on-line gambling applications, the House controls the computer application or web site through which a player bets. The House is generally in control of both managing the game and all associated financial transactions.

It is not surprising that security of such on-line gambling platforms is of utmost importance. Hackers may attempt to cheat and gain an unfair advantage in a variety of ways that would cause the House to lose significant sums of money by paying on bets that should not have been paid on, by allowing bets to be placed when the game outcome can be already be determined by unauthorized access, or by redirecting payments to parties that are not entitled to such payments. For example, a hacker may attempt to gain unauthorized access to view and in some cases even alter game information. In addition, individuals employed to work on the on-line gaming platform may be tempted to use their access to cheat the system.

Other considerations for on-line gambling platforms include, but are not limited to, concerns about the considerable resources used in complying with regulatory requirements, both for an original submission and for resubmissions when changes are made to a system, and, the highly variable demand (load) made on backend systems during game play.

DETAILED DESCRIPTION

The terms "gaming," "gambling," or the like, refer to activities, games, sessions, rounds, hands, rolls, operations, and other events related to wagering games, where a wagering game may be a web game, casino game, card game, dice game, and/or other games of chance for which wagers may be placed by a player. The word "wager," "bet," "bid" or the like, refer to any type of wagers, bets or gaming ventures that are placed on games that involve, or whose outcome is at least partially dependent on, one or more random events. A wager may be placed on games whose outcome may have monetary or non-monetary value. Examples of the different kinds of games include games based on dice rolls, slot machines, or roulette wheels, which are games whose outcome is based on chance (one or more random events). Draw poker is an example of a game whose outcome is based partially on one or more random events, and partially on skill. Chess is an example of a game involving no random events. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that are play for pay (aka play-for-pay) as well as play for fun (play for fun), as will be described in more detail below.

Gaming System Architecture

Figure 4:
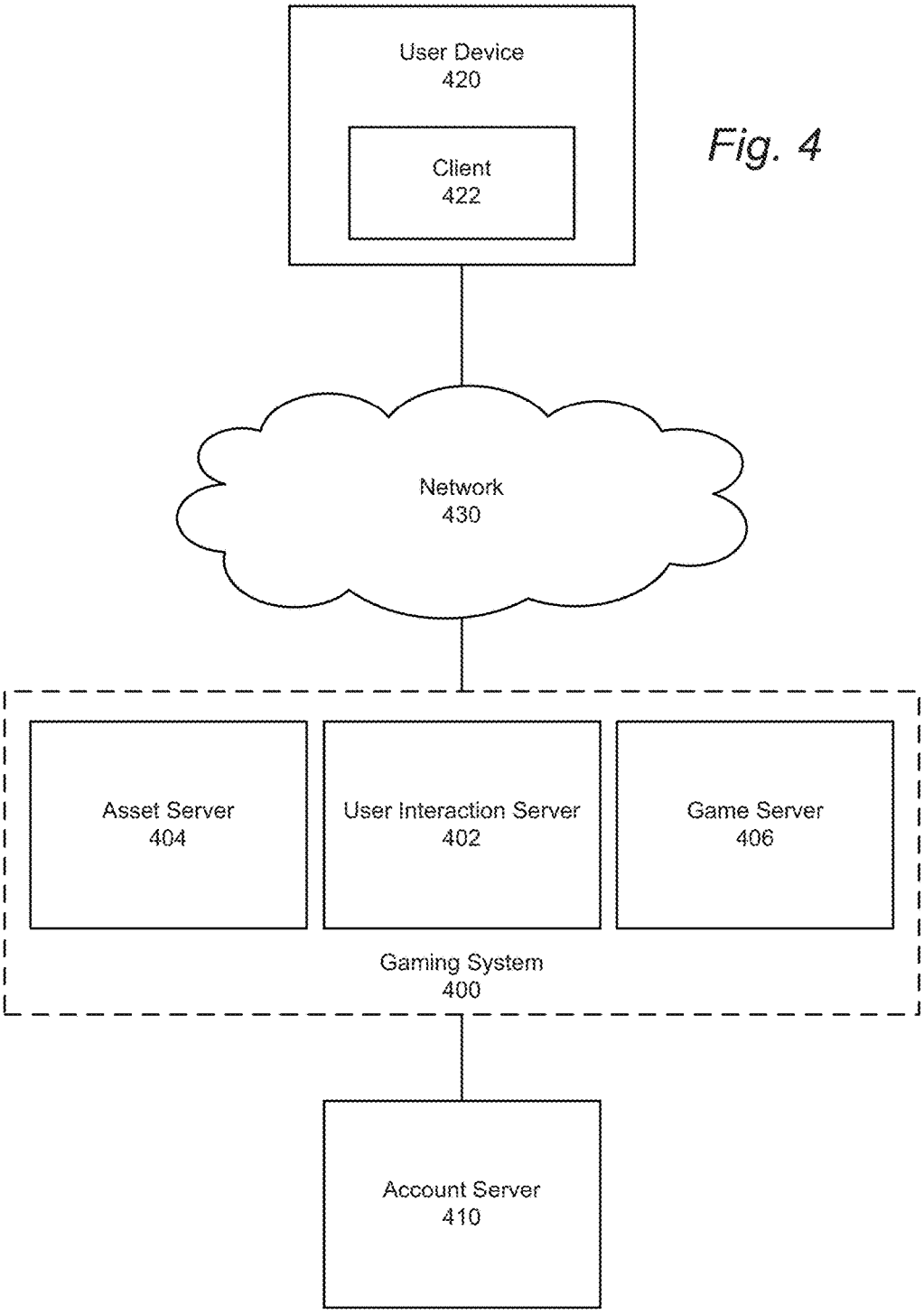
FIG. 4 is a schematic block diagram of a gaming system 400 for implementing waging games according to an embodiment.

FIG. 4 is a schematic block diagram of a gaming system 400 for implementing waging games according to an embodiment. The gaming system 400 enables end users to access proprietary game content. Such game content may include, without limitation, various types of wagering games such as card games, dice games, big wheel games, roulette, scratch off games, and any other wagering game with a randomized element in determining wagering outcomes. Such games in may be played against the gaming system or against other end users.

The wagering games supported by the gaming system 400 may be operated with real currency, virtual credits and/or countable elements. Countable elements are any one or more elements used to indicate amounts won or lost. For example, the real currency option may include traditional casino and lottery-type wagering games in which money or other items of value are wagered and may be cashed out at the end of a game session. The virtual credits option and/or countable elements may include wagering games in which credits (or other symbols, e.g., countable elements) may be issued to a player to be used for the wagers. Although credits may be won or lost, the ability of the player to cash out the credits may be prevented. In other words, while the credits may be purchased or otherwise awarded or made available to a player, the credits in a play for fun option may be limited to non-monetary credits in terms of the ability of the player to extract cash or goods or services of monetary value out of the wagering game. Systems that operate play for fun games may include issuance of free credits. In some embodiments, a limited number free credits may be issued in order to entice players to play the games. Credits may be won or lost, but credit balances may not be cashed out. In exchange for an action, e.g., identifying friends who may want to play, duration of play based on time or number of sessions, viewing and/or listening to an of advertisement or other audio/video presentation, the system may issue additional credits or achievable elements, described further below. Often, additional credits may be issued after a period of time has elapsed to encourage the player to continue or resume playing the game. The system may enable players to buy time, which triggers additional game credits to allow the player to resume play more quickly than waiting for a predetermined time period to pass. Objects of value may be awarded to play for fun players, which may or may not be in a direct exchange for credits. For example, the client may award a prize for a highest scoring play for fun player during a defined time interval.

Figure 10:
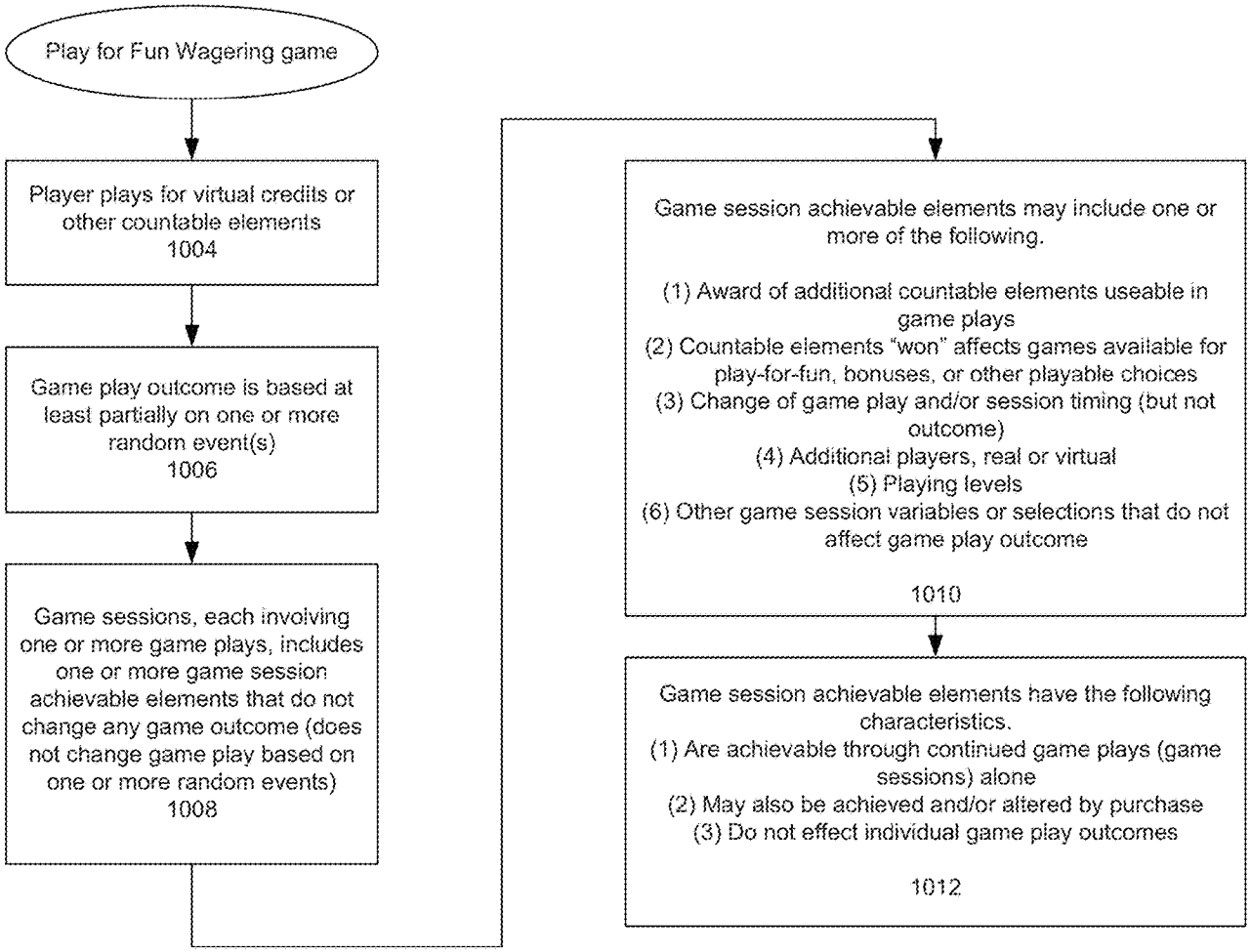
FIG. 10 is a flow chart illustrating a method enabling a play for fun game including virtual credits/countable elements in accordance with an embodiment of the present disclosure.

FIG. 10 is a flow chart illustrating a method enabling a play for fun game including virtual credits/countable elements in accordance with an embodiment of the present disclosure. Another feature of a game in accordance with some embodiments, is that in some games, e.g., in play for fun wagering games or game sessions where a player plays for virtual credits or other countable elements 1004 based on game play whose outcome is at least partially determined on one or more random events 1006, includes game session achievable elements that do not change a game play outcome 1008. One example of a game session achievable element is a countable element. Features of game session achievable elements can include (a) an award of additional game session achievable elements that are usable in future game plays, (b) unlocking additional games or features that are available for play for fun bonuses or other playable choices, (c) modification of game play and/or session timing (but not of outcome), (d) the addition of new real or virtual players and/or characters, and/or (e) advancement of playing levels, e.g., the advancement of levels to increase bonus payouts, improve payout odds, or alternatively, in a game where the countable elements relate at least in part to a "parallel" game, e.g. a role-playing game, in which levels are achieved which unlocks or otherwise makes available additional games and/or features. In various embodiments, game session achievable elements can be achieved through continued game plays/game sessions alone, and may also be achieved and/or altered by purchase, but do not affect individual game play outcomes 1010. In one play for fun example, a player is awarded additional game session achievable elements after a pre-set amount of time and/or a pre-set number of game plays (in alternate embodiments, the time/game plays need not be pre-set but can vary depending upon other factors, e.g., the amount of virtual currency wagered). If a player wants additional achievable elements, the player may purchase them or may earn them through game play, e.g., as part of winning wagers, time spent playing, etc. 1012.

Figure 11B:
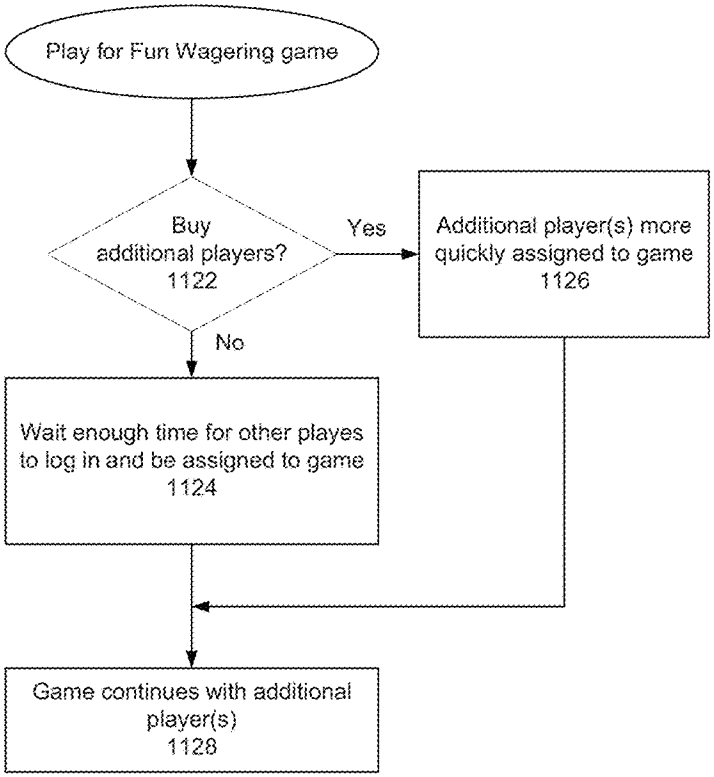
FIGS. 11*a-b* are a flow charts illustrating methods enabling a play for fun game having the options of purchasing additional countable elements and/or purchasing additional assignment of players for a game in accordance with an embodiment of the present disclosure.
Figure 11A:
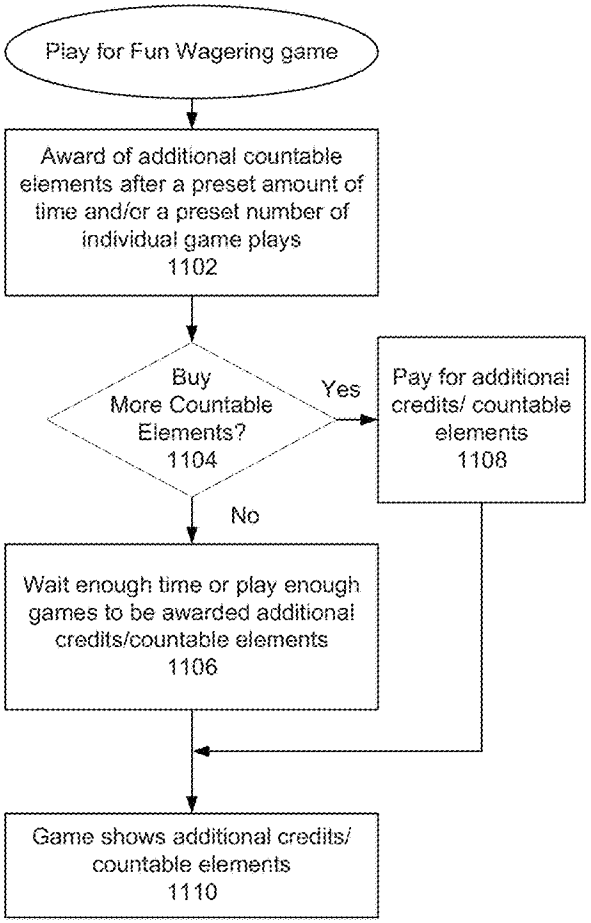

FIGS. 11*a-b* are a flow charts illustrating methods enabling a play for fun game having the options of purchasing additional countable elements and/or purchasing additional assignment of players for a game in accordance with an embodiment of the present disclosure. In the play for fun environment illustrated additional countable elements are awarded 1102 after a pre-set amount of time or game plays. The player may decide 1104 to purchase 1106 countable elements which are then shown 1110 in the game. In addition or alternatively, the player may continue to earn 1106 countable elements based on time and/or game plays. In another embodiment, decision 1104 is a choice to buy game time (game playing time), which is followed 1108 by the awarding of more game time which enables, triggers, or happens to trigger the awarding of addition countable elements. In another embodiment, decision 1104 is a choice to buy a number of additional game plays (as if the player had finished an additional number of individual game plays), which is followed 1108 by the awarding of more game plays which then enables, triggers, or happens to trigger awarding of addition countable elements In another example, if a play for fun player wants one or more additional players for a game 1122, e.g., if a certain number of players are needed to start the game, or if additional players are wanted even if not necessary to play, several different embodiments may be used to involve further players in the game session. In one embodiment decision diamond 1122 allows a player to use previously earned achievable elements to decrease the waiting time to have one or more real or virtual players join the player's game. In another embodiment decision 1122 allows a player to purchase players, which may be one or more virtual players (i.e., one or more player position(s) in the game session played by a computer or the system), or pay an early entry fee for a real player who is waiting to join a game session. The game continues 1128 with the additional player(s). If the player chooses not to buy one or more additional players, play continues 1124 where the player waits for the passage of time, carries out additional game plays, or achieves enough countable elements, for example, after which game play with additional player(s) continues in box 1128.

Figure 13:
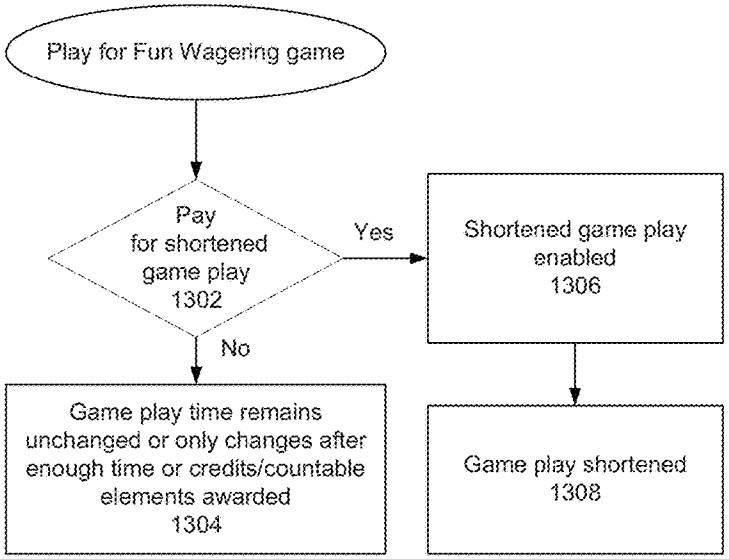
FIG. 13 is a flow chart illustrating a method enabling a play for fun game having the option of shortening the game play by player purchase in accordance with an embodiment of the present disclosure.
Figure 12:
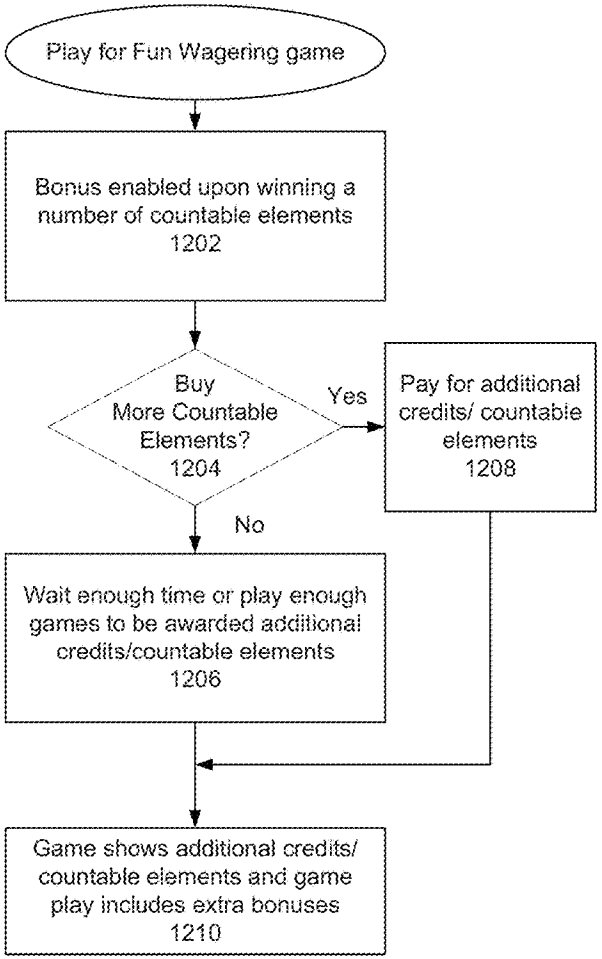
FIG. 12 is a flow chart illustrating a method enabling a play for fun game having the option of unlocking additional bonuses/game play by purchasing additional countable elements in accordance with an embodiment of the present disclosure.

FIG. 12 is a flow chart illustrating a method enabling a play for fun game having the option of unlocking additional bonuses/game play by purchasing additional countable elements in accordance with an embodiment of the present disclosure. In an embodiment decision 1204 allows for the purchase of a bonus, regardless of how many countable elements have been won. After purchase of a bonus the player is given the bonus 1208 and game play continues 1210 with the added bonus. A player may achieve a similar result by not paying for a bonus and continuing 1206, where a bonus is achieved through additional game plays, playing time, or other criteria. Game play continues 1210 with the addition of the bonus. FIG. 13 is a flow chart illustrating a method enabling a play for fun game having the option of shortening the game play by having a player purchase in accordance with an embodiment of the present disclosure. In one embodiment, a player pays for shortened game play 1302. Shortened game play entails any method where the computer or system enables a player to complete game play in less time than before the shortened game play is enabled 1306. In another embodiment, upon winning a pre-set (or variable) number of achievable elements, extra bonuses 1202 become available to the player or game software delays are reduced, for example, the player has the ability 1204/1302 to purchase 1208/1302 achievable countable elements exclusively or to supplement already earned/acquired achievable elements in order to earn 1210 the extra bonus or to reduce software delays in game play 1306/1308. Alternatively, the player may continue to earn the achievable elements, such as countable elements, without payment, and can take advantage of the extra bonuses 1206/quicker play 1304 when enough achievable elements are acquired.

A player may purchase assets using payment, virtual credits and/or achievable elements. Assets can include personalized asset data from the asset server 114, such as game play elements having a particular skin, theme, color, etc. In an embodiment the game provider provides pre-defined themes based on seasons/holidays, past-times, sports, characters etc. that may be made available for free or through purchase by currency or achievable elements, for example.

As described above, the player can be allocated achievable elements based on any of a variety of factors such as the number of game plays, number of game sessions, duration of playing, amount of bets, amount of winnings or losses (either virtual currency or real currency) of a player or group of players.

The gaming system 400 includes a gaming platform that establishes a portal for an end user to access a wagering game hosted by a game server 406 through a user interaction server 402. The user device 420 communicates with a user interaction server 402 of the gaming system 400 using a network 430. The user interaction server 402 communicates with the game server 406 and provides game information to the user. In some embodiments, a single user device communicates with a game provided by the game engine 406, while other embodiments may include a plurality of user devices 420 configured to communicate and provide end users with access to the same game provided by game engine 406. In addition, a plurality of end users may access a single user interaction server 402 or a plurality of user interaction servers 402 to access game server 406.

The user interaction server 402 communicates with the user device 420 to enable access to the gaming system 400. The user interaction server 402 allows a user to create and access a user account and interact with gaming server 406. The user interaction server 402 allows users to initiate new games, join existing games, and interface with games being played by the user.

The user interaction server 402 may also provide a client 422 for execution on the user device for accessing the gaming system 400. The client 422 provided by the gaming system 400 for execution on the user device 420 can comprise a variety of implementations according to the user device and method of communication with the gaming system 400. In one embodiment, the user device 420 connects to the gaming system 400 using a web browser and the client 422 executes within a browser window or frame of the web browser. In another embodiment, the client 422 is a stand-alone executable on the user device 420.

For example, the client 422 may comprise a relatively small amount of script (e.g., JavaScript), also referred to as a "script driver," including scripting language that controls an interface of the client 422. The script driver may include simple function calls requesting information from the gaming system 400. In other words, the script driver stored in the client 422 may merely include calls to functions that are externally defined by, and executed by, the gaming system 400. As a result, the client 422 may be characterized as a "thin client." As that term is used herein, the client 422 may be little more than a script player. The client 422 may simply send requests to the gaming system 400 rather than performing logic itself. The client 422 receives player inputs and the player inputs are passed to gaming system 400 for processing and executing the wagering game. In other embodiments, the client 422 comprises an executable rather than a script. As a result, the bulk of the processing of the game play is performed in the gaming system 400. The client 422 may receive intermediate data and final game outcome information from the gaming system 400 for displaying on the end user's computer after such is determined by the game engine 406.

In another embodiment, the client 422 implements further logic and game control methodology beyond the thin client described above. For example, the client 422 may parse and define player interactions prior to passing the player interactions to the gaming system 400. Likewise, when the client 422 receives a gaming interaction from the gaming system 400, the client 422 may be configured to determine how to modify the display as a result of the gaming interaction. The client 422 may also allow the player to change a perspective or otherwise interact with elements of the display which do not change aspects of the game.

The gaming system 400 also includes an asset server 404 which hosts various media assets (e.g., audio, video, and image files) that may be sent to the client 422 for presenting the various wagering games to the end user. In other words, in this embodiment the assets presented to the end user are stored separately from the client 422, and the client 422 requests the assets appropriate for the game played by the user. For example, the client 422 may call a function defined at the user interaction server 402 or asset server 404 which determines what assets are to be delivered to the client server 110 as well as how the assets are to be presented by the client 422 to the end user. Different assets may correspond to the various clients that may have access to the game engine 406 or to different games to be played.

The game server 406 is configured to perform game play methods and determine game play outcomes that are provided to the user interaction server 402 to be transmitted to user device 420 for display on the end user's computer. For example, the game server 406 may include game rules for one or more wagering games, such that the game 406 controls the game flow for a selected wagering game, as well as the determining game outcomes, pay tables, and other game logic. The game server 406 also performs random number generation for determining random game elements of the wagering game. The game server 406 is typically separated from the user interaction server 402 by a firewall or other method of preventing unauthorized access to the game server 406 from the general members of the network 430.

The term "firewall" as used herein encompasses conventional firewalls as well as other methods of preventing unauthorized access to a device. A firewall can be a bi-directional firewall, two separate firewalls each preventing unauthorized access to a device on separate sides of the firewalls, or a combination, for example. In the case where a "firewall" includes multiple firewalls, the firewalls may be located in physical proximity to each other or may be remote from each other.

As described below, with reference to FIGS. 1-3 and 6, for example, in some embodiments the gamer server includes multiple components, e.g., a games rules server 120, games database 135, deck server 122, which may be separated by additional firewalls.

The user device 420 presents a gaming interface to the player and communicates the user interaction to the gaming system 400. The user device 420 may be any electronic system capable of displaying gaming information, receiving user input and communicating the user input to the gaming system 400. As such, the user device 420 can be a desktop computer, a laptop, tablet computer, set-top box, mobile device, kiosk, terminal, or other computing device. The user device 420 operates the client 422 for connecting to the interactive gaming system 100 as described above. The client 422 may be a specialized application or may be executed within a generalized application capable of interpreting instructions from the interactive gaming system 400, such as a web browser.

The client 422 may interface with an end user through a web page, an application (e.g., a smartphone or tablet application), or other computer program in order to access the gaming system 100. The client 422 may be illustrated within a casino webpage (or other interface) indicating that the client 422 is embedded into a webpage, which is supported by a web browser executing on the client device 420.

The gaming system 400 may be operated by different entities in one embodiment. The user device 420 may be operated by a third party, such as a casino, that links to the gaming system 400. Therefore, in some embodiments, the user device 420 and client 422 is operated by a different administrator than the operator of the game server 406. In other words, the user device 420 may be part of a third-party system that does not administer the game engine 120. In another embodiment, the user interaction server 402 and asset server 404 are provided by a third-party system. For example, a gaming entity (e.g., a casino) may operate the user interaction server 402 or user device 420 to provide its customers access to game content managed by a different entity. In some embodiments, the these functions are operated by the same administrator. For example, a gaming entity (e.g., a casino) may elect to perform each of these functions in-house, such as providing both the access to the user device 420 and the actual game content and providing administration of the gaming system 400.

The gaming system 400 also communicate with external account servers 410, optionally through another firewall. For example, the gaming system itself may not take wagers or issue payouts. In other words, the gaming system 400 may facilitate online casino gaming, but may not be part of a self-contained online casino itself. Instead, the gaming system 400 may facilitate the play of proprietary card game content owned and controlled by a company offering games and gaming products and services, such as Shuffle Master, Inc. Another entity (e.g., a casino) may operate and maintain its external account servers 410 to take bets and make payout distributions. The gaming system 400 may communicate with the account servers 410 to verify the existence of funds for wagering, and instructs the account servers 410 to execute debits and credits.

In some embodiments, the gaming system 400 may take bets and make payout distributions, such as in the case where administrator of the gaming system 400 operates as a casino. As discussed above, the gaming system 400 may be integrated within the operations of a casino rather than separating out functionality (e.g., game content, game play, credits, debits, etc.) among different entities. In addition, for "play for fun" wagering games, the gaming system 400 may issue credits, take bets, manage the balance of the credits according to the game outcomes, but may not permit payout distributions or be linked to play for fun client servers that permit payout distributions. Such credits may be issued for free, through purchase, or for other reasons, without the ability for the player to cash out. Such play for fun wagering games may be played on platforms that do not permit traditional gambling, such as to comply with jurisdictions that do not permit online gambling.

As described herein, the gaming system 400 may be configured using a distributed server architecture. For example, the game server 406 may include a plurality of servers (e.g., game rules server, deck server, game routing server, account server, asset server, etc.) that are logically separated to perform different functions for the wagering game. Additional features may be supported by the game server 406, such as hacking and cheating detection, data storage and archival, metrics generation, messages generation, output formatting for different end user devices, as well as other features and operations. For example, the gaming system 400 may include additional features and configurations as described in U.S. patent application Ser. No. 13/353,194, filed Jan. 18, 2012, and entitled "Network Gaming Architecture, Gaming Systems, and Related Methods," the entire disclosure of which is incorporated herein by this reference.

The network 430 enables communications between the user device 420 and the gaming system 400. A network may also connect gaming system 400 and account server 410 (not shown). In one embodiment, the network 430 uses standard communications technologies and/or protocols. Thus, the network 430 can include links using technologies such as Ethernet, 802.11, worldwide interoperability for microwave access (WiMAX), 3G, digital subscriber line (DSL), asynchronous transfer mode (ATM), InfiniBand, PCI Express Advanced Switching, etc. Similarly, the networking protocols used on the network 430 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 430 can be represented using technologies and/or formats including the hypertext markup language (HTML), the extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 430 can also include links to other networks such as the Internet.

Computer Architecture

Figure 5:
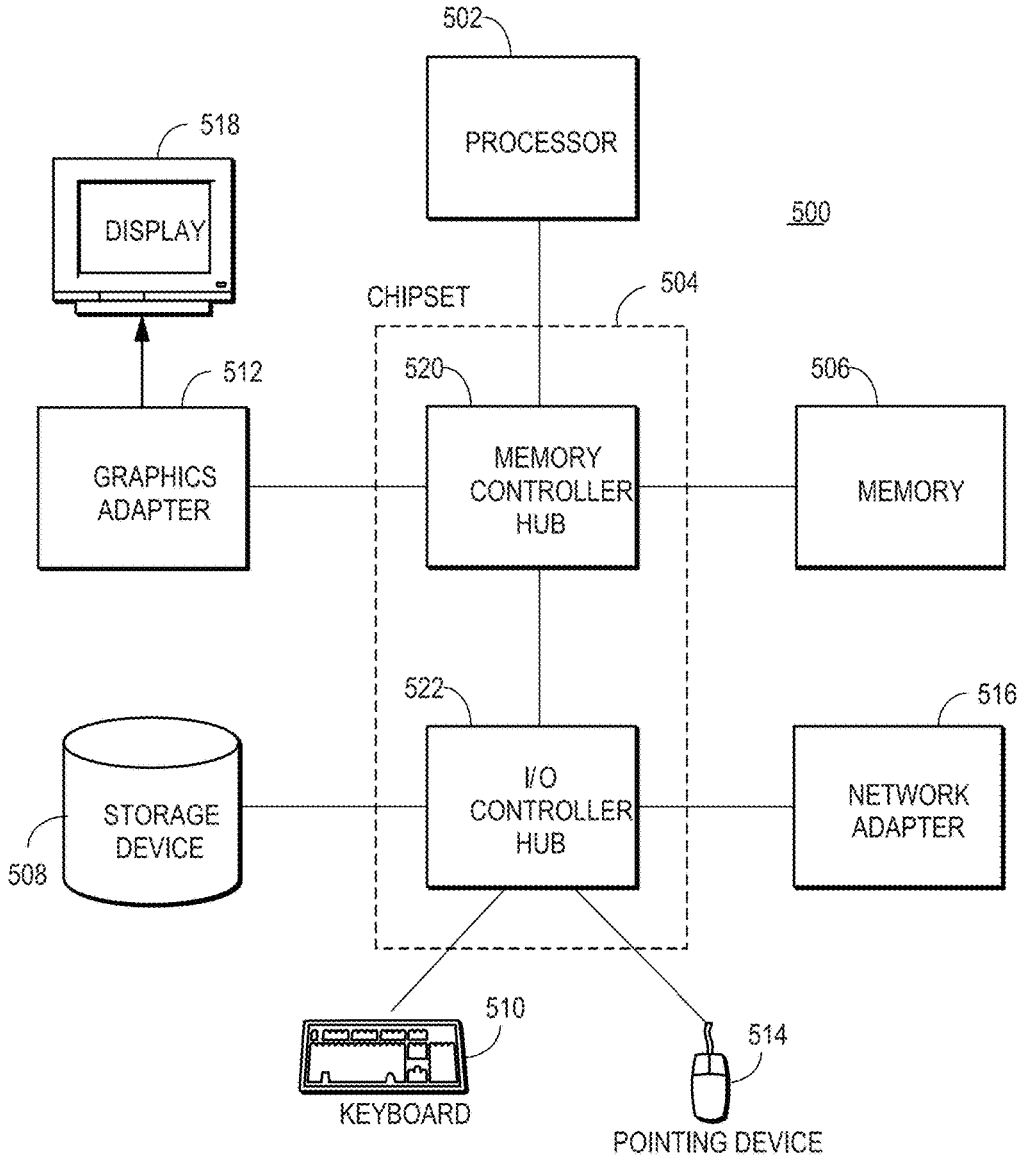
FIG. 5 is a high-level block diagram of a computer 500 for acting as a gaming system 400 according to one embodiment.

FIG. 5 is a high-level block diagram of a computer 500 for acting as a gaming system 400 according to one embodiment. Illustrated are at least one processor 502 coupled to a chipset 504. Also coupled to the chipset 504 are a memory 506, a storage device 508, a keyboard 510, a graphics adapter 512, a pointing device 514, and a network adapter 516. A display 518 is coupled to the graphics adapter 512. In one embodiment, the functionality of the chipset 504 is provided by a memory controller hub 520 and an I/O controller hub 522. In another embodiment, the memory 506 is coupled directly to the processor 502 instead of the chipset 504.

The storage device 508 is any non-transitory computer-readable storage medium, such as a hard drive, compact disk read-only memory (CD-ROM), DVD, or a solid-state memory device. The memory 506 holds instructions and data used by the processor 502. The pointing device 514 may be a mouse, track ball, or other type of pointing device, and is used in combination with the keyboard 510 to input data into the computer system 500. The graphics adapter 512 displays images and other information on the display 518. The network adapter 516 couples the computer system 500 to a local or wide area network.

As is known in the art, a computer 500 can have different and/or other components than those shown in FIG. 5. In addition, the computer 500 can lack certain illustrated components. In one embodiment, a computer 500 acting as a gaming system 400 lacks a keyboard 510, pointing device 514, graphics adapter 512, and/or display 518. Moreover, the storage device 508 can be local and/or remote from the computer 500 (such as embodied within a storage area network (SAN)).

The gaming system 400 may comprise several such computers 500. The gaming system 400 may include load balancers, firewalls, and various other components for assisting the gaming system 400 to provide services to a variety of user devices.

As is known in the art, the computer 500 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 508, loaded into the memory 506, and executed by the processor 502.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware or hardware, and when embodied in software, could be downloaded to reside on and be operated from different platforms used by a variety of operating systems. The embodiments can also be in a computer program product which can be executed on a computing system.

The embodiments also relates to an apparatus for performing the operations herein. This apparatus may be specially constructed for the purposes, e.g., a specific computer, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for disclosure of enablement and best mode.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments.

Figure 1A:
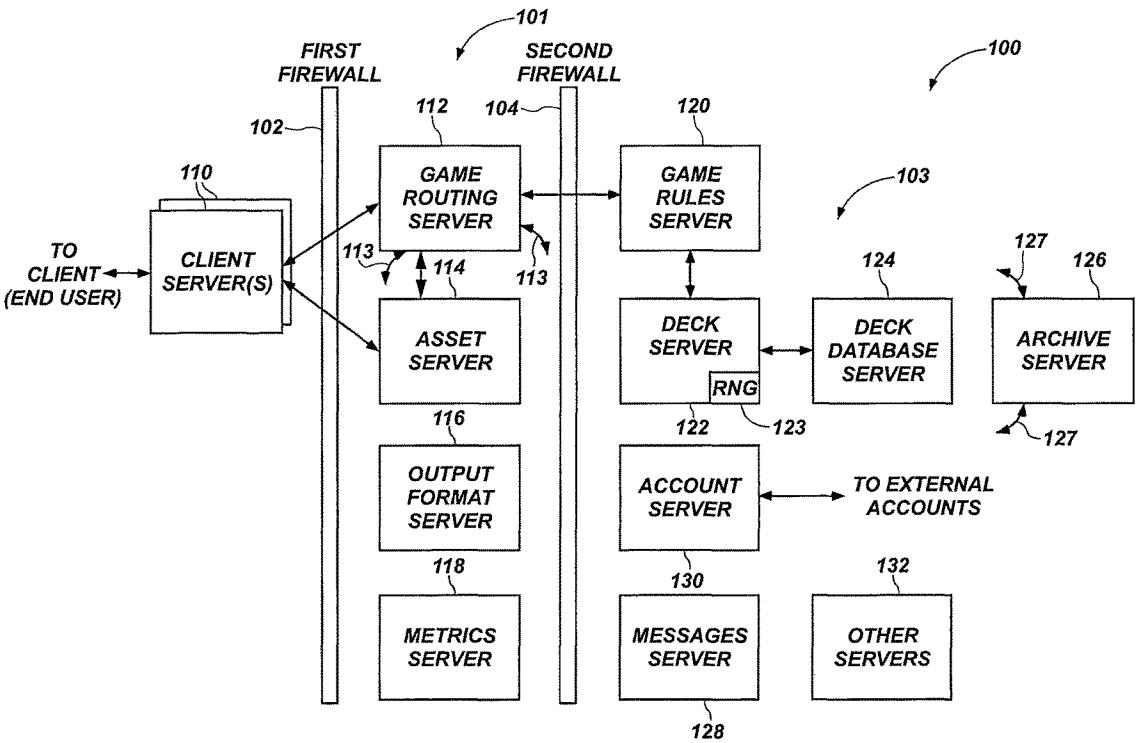
FIG. 1A is a schematic block diagram of a gaming system according to an embodiment of the present disclosure.

FIG. 1A is a schematic block diagram of a gaming system 100 according to an embodiment of the present disclosure. The gaming system 100 includes a gaming platform that establishes a portal for an end user (not shown) to access a wagering game through a client server 110. The portal enables the gaming system 100 to control game graphics, game play methods, and game play outcomes displayed on the end user's computer. The client server 110 may be configured to communicate with the gaming system 100 through the first firewall 102. In some embodiments, a single client server 110 may be provided to communicate with the gaming system 100, while other embodiments may include a plurality of client servers 110 configured to communicate and provide end users with access to the same gaming system 100. In addition, a plurality of end users may access a single client server 110 or a plurality of client servers 110.

In some embodiments, the client server 110 may not be part of the gaming system 100, in that the client server 110 may be operated by a different administrator than operates the other servers of the gaming system 100. In other words, the client server 110 may be part of a third-party system that does not administer the gaming system 100. For example, a gaming entity (e.g., a casino) may operate the client server 110 to provide its customers access to game content managed by a different entity. In some embodiments, the client server 110 may offer and/or provide access to content in addition to what is supported by the gaming system 100. As a result, the client server 110 may establish communication between the client and the gaming system 100, as well as the client and other content that is unrelated to the gaming system 100, including multiple different gaming systems that are not part of the gaming system 100. For example, a gaming entity may have a client server 110 that accesses game content from a plurality of different game administrators that provide access to different gaming systems (not shown).

It is also contemplated that in some embodiments, the client server 110 may be part of the gaming system 100, such as being operated by the same administrator as the gaming system 100. In addition, the client server 110 may be dedicated to access only game content that is supported by the gaming system 100. For example, a gaming entity (e.g., a casino) may elect to perform each of these functions in-house, such as providing both the access to the client server 110 and the actual game content and the organization, as well as providing administration of the other servers of the gaming system 100 as well.

The gaming system 100 includes a game routing server 112, an asset server 114, an output format server 116, a metrics server 118, a game rules server 120, a deck server 122, a deck database server 124, an archive server 126, a messages server 128, and an account server 130. Other servers 132 are also contemplated as being included within the gaming system 100. The various servers of the gaming system 100 may be configured to perform the described functions and communicate with each other in the manner that is described in more detail below. In addition, the various servers of the gaming system 100 may be organized in a plurality of different sub-systems that may group the servers according to similar levels of communication and security.

The gaming system 100 may include a first sub-system 101 and a second sub-system 103, such that the various servers may be organized and separated to communicate through a plurality of firewalls 102, 104. The first sub-system 101 may be configured to communicate with the client server 110 through the first firewall 102. For example, the first sub-system 101 may include the game routing server 112, the asset server 114, the output format server 116, and the metrics server 118. The second sub-system 103 may be configured to communicate with the first sub-system 101 through the second firewall 104. The second sub-system 103 may include the game rules server 120, the deck server 122, the deck database server 124, the archive server 126, the account server 130, the messages server 128, as well as one or more other servers 132. In other words, the first firewall 102 separates the client server 110 from the game routing server 112, the asset server 114, the output format server 116, and the metrics server 118.

The second sub-system 103 may be isolated from the client server 110 by the first sub-system 101. As a result, therefore, the client server 110 and the servers of the second sub-system 103 may be configured to communicate with each other only through the first sub-system 101 (and the first firewall 102 and/or second firewall 104, if provided). In other words, the second firewall 104 may further separate the game rules server 120, deck server 122, the deck database server 124, the archive server 126, the messages server 128, the account server 130, as well as other servers 132.

The various servers may be organized with respect to the first firewall 102 and the second firewall 104 in a variety of different combinations according to the different levels of security desired for each server. In other words, the specific organization of the servers with respect to the plurality of firewalls 102, 104 should not be viewed as limiting the scope of present disclosure unless specifically described as such. In addition, the gaming system 100 may include additional sub-systems (not shown) separated by additional firewalls (not shown). For example, a third sub-system, if provided, may be configured to communicate with the second sub-system 103 and this communication may be through a third firewall. In some embodiments, the third sub-system may include external accounts servers (not shown). In addition, more or fewer firewalls may be implemented.

As will be understood, therefore, the first sub-system 101 provides an interface (e.g., a gateway) through which the second sub-system 103 and optionally the third sub-system may communicate with the client server 110. The third sub-system is not shown in FIG. 1A; however, an example of such is shown as third sub-system 105 in FIG. 1B. The first sub-system 101 is configured to format information received from the second sub-system 103 and optionally the third sub-system (FIG. 1B) so that the information is in an appropriate format for reading and/or display by the client server 110. Similarly, the first sub-system 101 is configured to receive requests and information from the client server 110 and convert the requests and information into an appropriate format for processing by the second sub-system 103. Moreover, the first sub-system 101 (e.g., via game routing server 112) may perform a routing function such that requests and information from the client server 110 are routed to the appropriate components of the first sub-system 101 and the second sub-system 103.

The gaming system 100 provides gaming content and enables secure on-line gaming from the client server 110. In some embodiments, the gaming system 100 does not take wagers or issue payouts. In other words, the gaming system 100 may facilitate on-line casino gaming, but may not be an on-line casino itself. Instead, the gaming system 100 facilitates the play of proprietary card game content owned and controlled by a company offering games and gaming products and services, such as Shuffle Master, Inc. In such an embodiment, the client server 110 may interface with an end user through a web page, an application (e.g., a smartphone or tablet application such as those), or other computer program in order to access the gaming system 100. The client server 110 may be operated by a third party, such as a casino, that links to the gaming system 100 through the client server 110 via a network, such as the internet. As will be described in further detail below, the account server 130 may communicate with an external entity (e.g., a casino) that maintains end user accounts to take bets and make payout distributions. In such an embodiment, the gaming system 100 merely verifies the existence of funds for wagering, and instructs the external end user accounts to execute debits and credits. In some embodiments, the gaming system 100 may take bets and make payout distributions, such as in the case where administrator of the gaming system 100 operates as a casino. As discussed above, the gaming system 100 may be integrated within the operations of a casino rather than separating out functionality (e.g., game content, game play, credits, debits, etc.) among different entities. In addition, for "play for fun" wagering games, the gaming system 100 may issue credits, take bets, manage the balance of the credits according to the game outcomes, but may not permit payout distributions or be linked to play for fun client servers 110 that permit payout distributions. Such credits may be issued for free, through purchase, or for other reasons, without the ability for the player to cash out. Such play for fun wagering games may be played on platforms that do not permit traditional gambling, such as to comply with jurisdictions that do not permit on-line gambling.

In play for fun wagering games, several sources of income for the game host may be realized that do not involve wagering on game outcomes. This allows the games to be played by people in jurisdictions that do not allow wagering games on-line while providing entertainment for the player(s) and the potential for income to the hosting company or companies. In these embodiments, the system will provide a play for fun wagering game, where the wagers are made with strictly freely provided credits, symbols, or similar representations of something useable by the player to make a "wager" while playing. There is no monetary value associated with the credits; for example, there would be no fixed conversion rate between credits and $US. In one embodiment, they cannot be redeemed in any manner. In another embodiment credits may be redeemable for a prize of some kind; prize redemption embodiments may have prizes comply with the laws of the jurisdiction in which the player is located, and/or, may be based on the value of the prize to the game host.

What may be offered to a player are purchasable items to enhance game play, but have no direct relationship to the wager portion of the game. In one embodiment, players may purchase forms of time compressor (game play speedup). In card games, the game compressor may be to display card shuffling and hands dealt instantly at each stage of the game, rather than showing cards being shuffled and then dealt to a player one-by-one (or other relatively slow game actions). For roulette, the wheel spin time before the ball settles on a number may be reduced. For slot machines, the symbol spinning cycle may be reduced. For dice games, the "throw" of the dice may be shown as a result rather than as a graphical sequence of dice being shaken, thrown, and the rolling to a stop. Any or all steps could be shortened or eliminated. If the game requires a certain minimum number of players to play, a player may be offered a chance to buy other players (played by the system once bought) in order to allow the game to begin, or, because the player wants a certain number of players in a pool (i.e., the player prefers more than the number of players currently at the virtual table). If the game involves levels, the player may be allowed to buy levels until they get to the level they want to play. Levels may be skill levels, where a player buys their way on to a table of players at a certain skill level rather than always starting with beginners. Alternatively, if the game involves winning credits, the player may buy a level that is equivalent to having won a specified number of credits, without having to play the lower levels of the game. This helps or allows players to buy their way to the skill level they want to play at, without having to play through the lower skill levels first. Other embodiments may include buying more than the freely available number of credits, buying more credits during a game hand or session (ordinarily one would have to wait until the hand or session ended to get the free credits again), buy extra game pieces for certain games, etc.

In one embodiment, a system that has non-wager purchases that affect some aspect of a player's experience of the game play, such as the speed of certain game events, the ability to buy more credits over those provided for free play, or other options, will additionally be configured to allow any player to play entirely for free. Any player not having the money, or simply not wanting to pay for the play for fun experience, can always play the games. In this embodiment there will always be at least one, but may be more, ways to play for no-pay (free) in addition to each optional pay event. The optional pay events do not, therefore, change the pay-for-fun site into a play-for-money site. In addition, in some embodiments the underlying rules and random events for each game will be the same for either player type (free or enhanced with pay), while in other embodiments there may be some variability in the game rules depending on optional pay events. In some embodiments a site may have free-to-play games with purchasable options, and may further include a subset of games that may require an optional purchase event. The subset of purchasable games may include added side-bet games, higher-ante games, or other variants. The decision on which pay options are available may depend on the desires and needs of the target clientele, the jurisdictions in which players may be located, and other considerations.

In a further embodiment, any optional pay events will not change the underlying game rules nor the way random events are used during game play, nor any other aspect of the credit-awarding "wager" portion of the games. The optional pay events will only change other player interactions with the game site, such as overall speed of game events, game depictions on the screen, numbers of players, level of play, starting level, or other options. Non-paying players will always be able to play the same games, but will play through longer graphics or other visuals, go through levels one at a time, need to wait until a predetermined number of live players are available to start a new round or game session, etc. This type of embodiment may be used when there is a need or desire to show that any purchases made while playing on the play for fun site are clearly for non-wager options.

The client server 110 may be provided with a relatively small amount of script 111 (FIG. 1B) (e.g., JavaScript), also referred to as a "script driver," including scripting language that controls the interfacing of the client server 110 with the gaming system 100. For example, the script driver may be installed in the client server 110 upon a third party entering into an agreement with the administrator of the gaming system 100 to participate in the use of the gaming system 100. In addition, the script driver may control the graphics displayed on the client server 110 when an end user (i.e., a player) selects the desired wagering game regardless of the type of device used to provide access to the games loaded onto the gaming system 100. In other words, the client server 110 essentially becomes a thin client when the player selects a wagering game to play, and the client server 110 provides the client with the ability to communicate with the game routing server 112, the asset server 114, and the output format server 116.

The game routing server 112 is configured to communicate between the client server 110 and the other various servers of the gaming system 100. The game routing server 112 may be further configured to only permit external communication through the first firewall 102 to come from the client server 110. In other words, authorized client servers 110 may be the only outside servers that are authorized (e.g., white listed) through the first firewall 102 to communicate with the game routing server 112. In addition, the client server 110 may not be permitted to communicate directly with any of the other servers of the gaming system 100 other than the game routing server 112 or, in some cases, the asset server 114.

A primary function of game routing server 112 is to route game outcome information to the client server 110 via the first firewall 102 and to further communicate with the other servers of the gaming system 100. In other words, when the client communicates with the client server 110, the client server 110 communicates with the other servers of the gaming system 100 through the game routing server 112. At times, the client server 110 may communicate directly with the asset server 114 as will be described with more detail below. Although direct communication paths are shown in FIG. 1A between the game routing server 112 and the game rules server 120 only, the game routing server 112 may nevertheless have direct communication paths established between the other servers of the gaming system 100 as indicated by arrows 113. For example, the game routing server 112 may also have direct communication paths established with the asset server 114, the output format server 116, the metrics server 118, the messages server 128, the account server 130, and other servers 132. In some embodiments, the game routing server 112 may communicate with the deck database server 124 and the archive server 126. In some embodiments, the game routing server 112 may communicate with the deck server 122 through the game rules server 120 only. This limited access to the deck server 122 may be for security reasons, to limit those who have access to deck information, and will be described more fully below. The communication links between servers will be discussed further below with respect to FIG. 1B describing the data flow and access permissions between the various servers of the gaming system 100B.

Referring still to FIG. 1A generally, the game routing server 112 directs data flow between client server 110 and the servers of the gaming system 100. The game routing server 112 may perform a relatively low amount of processing itself, and may simply route data to the appropriate location. As a result, the game routing server 112 may be inexpensive, such as from a computational standpoint, relative to some of the other servers of the gaming system 100. The main processing of the gaming system 100 may occur in the game engine, which may include the game rules server 120, and the deck server 122. Some processing of the gaming system 100 may also occur in the account server 130. The various other servers may also perform some processing according to the functions described below.

The game routing server 112 receives inputs into the gaming system 100 from the client server 110. For example, the client server 110 may send data indicating which wagering game is to be played, and game inputs such as player moves (e.g., bets, card requests, holds, etc.). Such inputs may be routed to the appropriate location, such as the game rules server 120 associated with the appropriate wagering game. The game routing server 112 may be scaled (e.g., the number of servers may be increased) to handle different games as new wagering games are released and supported by the gaming system 100 with the addition of additional game rules servers 120. Thus, a plurality of game rules servers 120 may share the game routing server 112. As a result, the more games that are added to the system, the more the cost per player per game may be reduced because resources will be shared among games. Also, as the number of clients and client servers 110 increase the number of game routing servers 112 may be increased. This approach of scaling individual servers according to need for that particular function is unlike that of conventional gaming systems, which tend to duplicate server resources for individual games (e.g., a Texas Hold 'Em variant, blackjack, etc.), which may result greater equipment and hosting expenses.

The game rules server 120 includes game rule information for at least one wagering game stored thereon. The game rules server 120 may be thought of as the game engine that controls the order of game play. For example, game rule information may include the game rules of a particular wagering game and the various stages of play. For example, the game rules include the number and order of cards to be dealt to various positions, such as the different player positions, common card positions, dealer card positions, whether cards may be shown, etc. The game rules may further include the relative ranking of hands in a card game (e.g., poker), whether the player hand is played against a dealer hand or against pay tables, and the pay tables themselves that are used to determine the amount of a payout award. In addition, the game rules may further include wager requirements such as whether wagers are mandatory or optional, the relative size of the wagers, the wager election choices, a comparison of the wager amounts made to table limits, and the like. Through the game rules server 120, the game rules ultimately determine whether the end user wins or loses, while the game routing server 112 determines what to do with such information.

As discussed briefly above, each wagering game supported by the gaming system 100 may have at least one different game rules server 120 associated therewith. In other words, in some embodiments, a set of game rules for any one game may be administered on the game rules server 120. For example, there may be at least one game rules server 120 for blackjack, at least one game rules server 120 for a Texas Hold 'Em variant, and so on. Each game rules server 120 may include game rules dedicated to a specific wagering game and does not comingle such information used by other games. Of course, the scale of the gaming system 100 and the complexity of the games may require a plurality of game rules servers 120 that are dedicated to a particular wagering game. In other embodiments, multiple sets of game rules are administered by the same game rules server 120. In other words, sets of game rules for a plurality of games may be administered by the same game rules server 120. For example, the same game rules server 120 may administer a set of game rules for the Texas Hold 'Em variant as well as a set of game rules for blackjack.

The deck server 122 is configured to provide the processing for generating the random game pieces (i.e., game piece indication) from a defined set of game pieces for the wagering game. For example, the deck server 122 includes a random number generator (RNG) 123 that is configured to randomly generate the game pieces in response to requests made from the game rules server 120 according to the rules of the wagering game being played by the end user. The random number generator 123 may be hardware based, software based, or a combination thereof. The term "random" also includes semi-random and pseudo-random events. The random number generator 123 employed shall pass a sufficient test of randomness. For example, The random number generator 123 may be created at a low-level programming level in order to sufficiently reduce or avoid language specific bugs. In operation, the random numbers may be appropriately seeded, and requests for numbers may not be done sequentially in order to ensure that the number pass an appropriate threshold test for randomness. The deck server 122 may compile a virtual deck of cards by indexing all the possible card values for a desired deck, and selecting at random one of those cards and placing it in a "shuffled" virtual deck. This process of card selection may be continued until all of the virtual cards have been placed in the virtual deck. The random number generator 123 may be implemented through one of a number of public domain and licensable random number generation algorithms, such as the CONVERSE Pseudorandom Number Generator (PRNG) developed by the University of Illinois at Urbana-Champaign of Champaign. Another example is the Park-Miller "minimal standard" PRNG, developed by Stephen K. Park and Keith W. Miller. Other methods are contemplated for ensuring that the random number generator generates a random number that passes the appropriate standard for randomness. In addition, it is recognized that standards for randomness may change over time, and that additional random number generators 123 may be developed for use with the gaming system 100.

The term "deck" is used because many common wagering games employ the use of playing cards, such as poker, Texas Hold 'Em variants, blackjack, among others. As discussed above, a non card-based game may be played that is supported by the gaming system 100. Thus, the term "deck" is not to be interpreted as requiring card deck information unless specifically stated to have such according to the game rules of the specific wagering game to be played. As the gaming system 100 includes an on-line gaming platform, the randomly selected game pieces may be thought of as virtual game pieces, such as virtual cards, virtual dice, virtual wheel positions, etc. Thus, the deck server 122 is configured to output a game piece indication which may comprise the identifier of a virtual card (e.g. the ten of hearts), a random number, one or more dice faces, a virtual wheel position, a number, a color, or the like, as well as combinations thereof. A "virtual shoe" may be referred to herein to describe the functionality of creating a virtual card deck and dispensing virtual cards as requested by the game rules server 120. In other words, the deck server 122 may generate a data file that represents the entire set of game pieces, and track the removal of cards delivered to the game such that the composition of the unused cards is also known at all times. This accounting function may prevent a card of a certain rank and suit from being dealt into the game so that the mathematics of the game is identical to a live card game and is not altered.

Using the example of a card-based game, the random number generator 123 may be used to generate one or more numbers that is used to select the card (or cards) from among the set of cards. One or more numbers may select the number and the suit of the cards. In other words, the deck server 122 serves the function of a virtual shoe to create the deck, and to hold and administer the card data for the wagering game. For example, such card data may include the initial number of cards in the set, the current number of cards in the set, the rank and suit of cards that have been removed from the set and dealt into the wagering game, the number of special cards such as promotional cards inserted into the set, the number of standard cards removed from the set to construct a special set (e.g., for the Spanish 21 game, Canasta, etc.), the number and color combination of hands dealt, the number of cards dealt to each player, the number of players in a round, etc. For poker variants, the set of cards is generally a standard deck of fifty-two cards having four standard suits. If desired, one or more jokers may be included. Blackjack games may be played with one or more combined decks of cards belonging to the set of cards. Common examples of blackjack games include one, two, four, six, or eight decks of cards. Baccarat is usually played with six or eight decks of cards belonging to the set. In the example of a non card-based game (e.g., roulette), the random number generator 123 may generate a number that is used according to the game rules of that wagering game. In creating the deck and administering the wagering game, or otherwise randomly generating the game pieces, the data may be encrypted and stored in the deck database server 124, as described below.

The deck server 122 and the game rules server 120 are separate and distinct servers. As a result, the card deck data is segregated from the game rules data on different servers. In addition, the deck server 122 and the game rules server 120 may be separated to have different access privileges to different sets of employees. Doing so may increase the security of the gaming system 100 as it limits the chances that a single employee has access to both sets of information associated with the game rules server 120 and the deck server 122. Separating the game rules data and the deck data into different servers further adds another level for a hacker to penetrate in order to obtain both sets of data during game play.

Data that is stored in the deck server 122 may be encrypted and is sent to the game rules server 120 in encrypted form, where it is decrypted and used by the game rules server 120. The encryption provides a higher level of security to the gaming system 100 and is described in more detail below. In addition, data generated by the deck server 122 may be withheld from the game rules server 120 until such information is required for the determination of the game outcome, at certain intermediate game determinations, or at a time where it is required to make such information known to the end user.

An example of a wagering game supported by the gaming system 100 is a Hold 'Em poker variant game (also referred to as "Ultimate Texas Hold 'Em"®) as described in U.S. patent application Ser. No. 11/156,352, filed on Jun. 17, 2005, and published as U.S. Patent Publication No. US 2006/0284376 A1, the entire disclosure of which is incorporated herein by this reference. In such an Ultimate Texas Hold 'Em game, there may be multiple rounds of betting, and multiple steps of card distribution and revelation of cards to the player. The gaming system 100 may be configured to wait to transfer intermediate game information, such as additional card rank and suit information from the deck server 122 to the game rules server 120 and/or the game routing server 112 on an as-needed basis. Additional game information may include, but is not limited to, extra wagers made, decisions to withdraw a wager, decisions to buy a card, decisions to fold, set a hand, a selection of a multiplier, a decision to participate in a bonus event, decisions to take hit cards, roll dice, spin wheels, activate a virtual shuffler to dispense more cards, exchange all or part of a hand with new cards, and any other decision that may be made during play of a wagering game and before conclusion of play.

As cards (or other game pieces) are needed, the game rules server 120 may request them. For example, the game rules server 120 may verify that the appropriate wager has been placed before requesting the next set of information. For example, after confirming an initial wager, the gaming system 100 deals an initial partial hand of cards to each player, whereupon the player may be asked to place another wager prior to receiving a full hand of cards. After receiving verification that the additional wager has been made, additional card data is provided to the game rules server 120. Thus, a game may require a first wager prior to the game routing server 112 delivering partial hand information in a card game to the game rules server 120, or to the client via the client server 110 according to the rules of the wagering game. The partial hand information may be considered intermediate game information. The game may also require information indicating a second wager has been made before delivering additional card information to complete the hand. This additional card information may also be considered intermediate game information.

Some of the intermediate game information may be withheld from the client server 110 as well as the game rules server 120 until all wagers have been completed and the withheld information is needed for the final game outcome determination. In addition, even if a person were to access (e.g., hack) the client server 110 or the game rules server 120 prior to that time, the person would not have access to that card information. As a result, cheating may be more difficult for such unauthorized users. Upon receiving confirmation that the game outcome (or an appropriate intermediate step) to be determined, the game rules server 120 may request the card information regarding the intermediate game information. Preventing the transmission of intermediate game information to the game rules server 120 prior to receiving a wager confirmation ensures that the gaming system 100 does not make a payout on a wager that was not received, and further reduces the risk of the game results being viewed and wagered upon if a person successfully hacks into the client server 110 or even the game rules server 120 for the purpose of retrieving card information or game results in advance of making a wager.

The asset server 114 includes asset data that is to be retrieved and used in the presentation of the wagering games on the client interfaces and may be similar to asset server 404 in FIG. 4. In other words, the asset server 114 may deliver content to the client through the client server 110 related to the presentation of the wagering game. For example, asset data may include image data, audio data, video data, and other similar data that may be used by a particular wagering game. As an example, image data may include the appearance of the background layout for a wagering game. For a wagering game such as a Texas Hold 'Em variant, the background layout may appear as a casino table surface. In addition, image data may include including a copyrighted and/or trademarked game games and logos of the wagering game or an entity (e.g., a specific casino, website, application, etc.), as well as the desired appearance of the card backs and card faces. The various types of asset data requested by the client server 110 may depend on the wagering game, the entity, or other desires. Although the asset server 114 is shown as being behind the first firewall 102, in some embodiments, the asset server 114 may be communicate with the client server 110 outside of the first firewall 102.

The output format server 116 is configured to format the game data, wagering data, and graphics files to accommodate different end user devices of the client such that the client receives all data in a format that the client can process. For example, end user devices may include personal computers (PCs), smart phones (e.g., an iPhone, Android, Blackberry, etc.), laptops, tablets, gaming machines, and other electronic devices that may communicate with the client server 110 for a user to play a wagering game. The output format server 116 may detect the type of end user device, as well as the operating system, and configure the data as appropriate for the client to process.

The metrics server 118 is a business intelligence control system that analyzes usage of each server of the gaming system 100, enables data mining, generates reports, and detects system weaknesses and/or system failures. Each of the various servers of the gaming system 100 may communicate with the metrics server 118. The client server 110 may also communicate with the metrics server 118 regardless of whether or not the client server 110 is part of the gaming system 100. Each of the various servers self report information regarding its actions to the metrics server 118. For example, the client server 110 may send information regarding its actions to the metrics server 118. For example, the client server 110 may send information of actions such as "began load," "load complete," "started," and "ended action" along with payload data containing the time started, system specifications, and any other information that a business intelligence group may deem relevant. As another example, the game rules server 120 may self report information regarding its actions at the end of each hand, such as reporting the game outcome along with payload data like the amount wagered, the amount won, any bonuses, and any other information the business intelligence group may deem relevant. The other various servers of the gaming system 100 may likewise self report information regarding their actions. The data stored by the metrics server 118 may be mined to generate reports for review by the business intelligence group. Such reports may be available on demand, or according to a set schedule.

The deck database server 124 is configured to receive and store game piece indications (e.g., deck data) from the deck server 122 to maintain an historical record. Thus, the deck database server 124 may communicate directly with the deck server 122 without routing through the game routing server 112. The deck data that is stored in the deck database server 124 may be data that is desired to persist during the operation of the wagering game or that is not resolved in a single client communication. For example, in a Texas Hold 'Em variant game, multiple turns are performed prior to finishing a game. Deck data from intermediate turns may be stored in the deck database server 124. The deck data stored in the deck database server 124 may be analyzed, as a security measure. For example, the client server 110 may want a running report confirming that each virtual shoe used to deal blackjack was verified as having a complete set of cards at the beginning of the deal, that the correct cards remain in the virtual shoe after the cut card appears, and that the dispensed cards equal the composition of the set of cards used by the virtual shoe. The deck data stored in the deck database server 124 may be stored independently from deck data stored elsewhere in the gaming system 100. The deck database server 124 may also be used to retain card information (e.g., card sets, card usage, etc.) from current or previous rounds of play to verify jackpot hands. This card information may also be transferred to the archive server 126 described below.

The messages server 128 is configured to store a list of messages for display to the end user, and send the appropriate message to the client server 110 upon request. Examples of system messages for display to end users may include an indication that a particular wager made was not placed, unavailable, is deficient, an indication regarding the status of the game, that an award has been earned, as well as other messages. The various servers of the gaming system 100 may request that messages be sent to the client. The game routing server 112 may process these message requests, route the message requests to the messages server 128, and receive the appropriate messages. The game routing server 112 may determine when to deliver the messages to the client server 110, such as prioritizing the transmission of a plurality of received messages to ensure that critical messages are transmitted first.

The account server 130 includes data such as user information (e.g., user names, passwords, email address, other user information, etc.), user validation (e.g., logging in, logging out, timing out, etc.), as well as user financial information (e.g., account balance, currency conversion, credits, debits, etc.). Account server 130 may be similar to account sever 410 described above with reference to FIG. 4. As discussed above, in some embodiments the gaming system 100 may not actually perform the transfers of funds. In such an embodiment, the account server 130 acts as an intermediary with an external account to confirm that funds are available for wagering and to communicate whether funds should be debited or credited and the end of the wagering game. The account server 130 may integrate with multiple different account platforms (e.g., Ongame, CyberArts, OpenBet, etc.) for communicating with the external accounts. The gaming system 100 may include a separate account server 130 for each account platform type. Therefore, depending on the integrated partner (if any) of the gaming system 100, the account server 130 may be an internal account system or an abstracted library to an external account system. The account server 130 also manages player accounts in play for fun wagering activities that do not permit a player to cash out won credits. For example, the account server 130 may communicate with external accounts that support play for fun wagering activities, which may be different than the external accounts that support wagering activities.

The account server 130 may cache certain types of player data for repeat access. For example, basic information that can uniquely identify a player might be stored for a period (e.g., days). The account balance of the external account may not be cached, and may be retrieved on demand at each wager.

The archive server 126 may include various data collected from the gaming system 100. For example, the deck data generated in the deck server 122 may be stored in an archived deck database of the archive server 126 after a full wagering game is resolved. Because the full wagering game is completed, the deck data stored in the archive server 126 may be unsecured. For example, the deck data may be decrypted and stored in the archive server 126 along with other game data. The archive server 126 may be selectively accessible to customer service and business intelligence employees. As an example, if a customer service representative receives a call, they may need unsecured access to verify and check the deck data and the game data to see if there was a mistake in the game play, and resolving player and/or casino client payout disputes. The data stored in the archive server 126 may be held independently of any corresponding data held in other parts of the gaming system 100. In other embodiments, the data stored in the archive server 126 may be secured.

The archive server 126 may also perform post processing of the deck data to detect cheating by comparing deck data stored in the archive server 126 with deck data stored in a secured location, such as the deck server 122 or the deck database server 124. The archive server 126 may also have the ability to call for "shift keys" from each of the servers of the gaming system 100, and in the absence of receiving the keys from the other processors (indicating an acceptable game state), the archive server 126 may shut down the gaming system 100 as a further security measure. Arrows 127 are shown to indicate that the archive server 126 may communicate with each of the servers of the gaming system 100.

Other servers 132 are also contemplated that may be part of the gaming system 100. An example of such another server 132 includes a social server. A social server may be configured to receive information regarding the game outcome and share that information with a social media platform (e.g., Facebook, Google Plus, Twitter, etc.). For example, if an end user wins a poker hand, that information may be posted on the end user's Facebook wall. Another example of another server 132 is a player's club server. A player's club server may credit the end user with rewards such as reward points for certain events, such as frequent gaming.

As discussed above, the client server 110 may be a "thin client." As that term is used herein, the client server 110 may be little more than a script player. The client server 110 may simply send requests to the gaming system 100 rather than performing logic itself. In other words, the script stored in the client server 110 may merely include calls to functions that are externally defined. While the client may receive player inputs, the inputs are merely passed on to the game routing server 112, and the bulk of the processing of the game play is performed in the game rules server 120 and the deck server 122 described more fully below. The client may receive intermediate data and final game outcome information to display after such is determined by the game rules server 120. In addition, the externally defined functions may determine what information is displayed by the client as well as how it is displayed. Also, the assets are stored separately from the client server 110 on the asset server 114, which the client server 110 downloads while running the script. As a result, if certain features and displays are desired to be changed, the administrator of the gaming system 100 may do so without needing access to each and every client server 110 that may access the gaming system 100. As a result, modifications to the gaming system 100 may be done more efficiently, particularly for embodiments that include a third party entity that runs the client server 110 as a business partner with the administrator of the gaming system 100.

General operation of the gaming system 100 will now be discussed. The script for the client may be initiated, such as by being embedded in a webpage, opened by a computer file, opened as an application on a mobile device, etc. The end user interfaces with the client server 110 to play the wagering game. As discussed above, the script driver stored in the client server 110 enables the client server 110 communicate with the gaming system 100 to begin a wagering game. The client server 110 may initiate a game by communicating with the game rules server 120 through the game routing server 112. In response to initiating the desired wagering game, the script driver further enables the client server 110 to receive asset files (e.g., images, video, audio, etc.) from a game library in the asset server 114, and to transfer the corresponding asset files to the client server 110 to be presented by the end-user's game display. As an example, the client server 110 may inform the game routing server 112 that a game is to be initiated. The game routing server 112 may query the asset server 114 to determine what assets are needed to run the desired wagering game and return the asset list to the client server 110. The client server 110 may receive an asset list from the game routing server 112 for the particular wagering game selected. The client server 110 may request the assets directly from the asset server 114 according to the asset list provided. Given such an asset list, the game routing server 112 may cache the asset list for future use if contacted by the client server 110 or another client server 110 to initiate another wagering game of the same type.

Once set up of the wagering game is complete, the client server 110 may communicate to the game routing server 112 that the wagering game is ready to begin. The end user may play wagering game according to the game rules stored in the game rules server 120. As discussed above, the game routing server 112 may route information between the client server 110 and between the various servers of the gaming system 100. For example, the end user may input information (i.e., press buttons on the display) that communicate to the game routing server 112 the desired actions. As a thin client, the client server 110 may not have the logic to know what the actions mean, just that a certain button is selected. The game rules server 120 is configured to interpret that information for the particular wagering game being played. Also, as discussed above, the game rules server 120 and the deck server 122 communicate to request the random game pieces according to the game play as defined in the game rules of the wagering data stored in the game rules server 120. The random game pieces (e.g., deck data) may be shared with the game rules server 120 and the client server 110 at the appropriate times according to the game play, wagers, and other factors. Accordingly, the game rule data and game outcome data are kept separate and not accessible without authorization.

As an example of game play, the game rules server 120 may include a plurality of different states that are moved between depending on the game. A first state may include the selection of the wagering game to be played. The next state may be to wait for the bet to be placed. If it has not done so already, the account server 130 may communicate with the external accounts to verify the funds for a player (i.e. an end user) are available to be bet. After the bet is placed, a game piece (e.g., such as one or more cards) may be issued to the player. Depending on the specific game rules, additional bets may be made and intermediate game pieces may be issued. Another state may be to do a final verification of the bets for sufficient funds for the player, after which the final game pieces may be sent to the game rules server 120 and the game outcome may be determined. Credits or debits are made to the end user's account through the account server 130 depending on the outcome of the wagering game and the bet and/or additional bet placed by the end user.

The gaming system 100 includes a plurality of different server components, each serving a separate function. The gaming system 100 is also separated in different levels of sub-systems 101, 103 that have limited communication there between. For example, communication from the client server 110 to the servers of the second sub-system 103 may occur through the game routing server 112 adding an extra level (and extra firewall) of security to the more sensitive components of the gaming system 100, such as the game rules server 120, the deck server 122 and the account server 130. These sensitive components of the gaming system 100 are, therefore, isolated from the client server 110, and any attempts that may be made to gain unauthorized access to the second sub-system 103 via the client server 110, also require passing the security measures implemented for the first sub-system 101. Therefore, the risks of an anomaly caused by an intruder being undetected may be reduced because an intruder may need to access multiple servers undetected in order to successfully hide any alterations made to one of the servers (such as the deck server 122, the game rules server 120, or the account server 130).

In addition to the security benefits described above, embodiments of the present disclosure may result in cost benefits as well. For example, scaling of the gaming system 100 may be performed in a more efficient manner according to the embodiments of the present disclosure. By separating the data and functions performed into separate servers, some of the servers may be duplicated to increase the scale of the gaming system 100 without the need to duplicate or replace other servers having other functions. For example, the game rules server 120 may be duplicated as additional games are added to the gaming system 100, as additional client servers 110 are added to the gaming system 100, or when additional players access the gaming system 100. On the other hand, other system servers may not require scaling (e.g., duplication) at the same time the game rules server 120 demand increases. As another example, changing the assets stored on the asset server 114 may be accomplished with only minor modifications (if any) to the other servers of the first sub-system 101 (such as updating the list of assets available), and without any of the servers of the second sub-system 103 requiring modification.

Servers may also be scaled at different rates. For example, the account server 130 may need to increase in scaling prior to the need to increase the scaling of the asset server 114. As another example, as different end user devices are developed, the output format server 116 may require reconfiguration, but not the balance of the gaming system 100. Scaling may occur as new features or information are changed by the administrator. Increasing and decreasing the scaling of the individual servers of the gaming system 100 may also be performed as a result of a need to keep up with the changing demand during player usage of the gaming system 100. Conventional approaches that essentially combine functions of all of the above servers into a single non-separated server may result in unnecessary duplication of data as the system is scaled to meet demand.

It is contemplated that embodiments of the present disclosure include architectures wherein at least some of the functionality of the various servers may be combined. Doing so, however, may at least partially reduce some of the efficiencies of scalability described above. An example of such includes a server that at least partially combines the functionality of two or more of the metrics server 118, the messages server 128, and the account server 130. Another example includes a server that at least partially includes the functionality of two or more of the game routing server 112, the game rules server 120, and the output format server 116.

In addition, another method of segregating data and functions into a plurality of different servers may include segregation of servers by whether or not the data or software code is regulated by gaming regulation authorities. Such segregation may reduce costs associated with satisfying regulatory requirements over time.

As discussed above, the gaming system 100 may include wagering games on a play for pay basis, wherein the gaming system 100 manages accounts (whether internal or external to the gaming system 100) that are adjusted according to the game outcome, and that permit a player to cash out. In some embodiments, the gaming system 100 may include wagering games on a play for fun basis, wherein the gaming system 100 manages accounts (whether internal or external to the gaming system 100) that are adjusted according to the game outcome, and that do not permit a player to cash out. For example, a player may be issued (e.g., through purchase) credits (or another symbol) that may be used to place wagers during the wagering game. During game play, the credits may be increased or decreased according to the game outcome. As the credits expire, the player may need additional credits before continuing additional play. The additional credits may be purchased or issued through other methods, as described above.

The play for pay feature and the play for fun feature may be at least partially integrated into the same gaming system 100. In other words, the gaming system 100 may be configured as a dual-purpose internet platform such that the various servers (e.g., game routing server 112, game rules server 120, deck server 122, etc.) of the gaming system 100 may be shared by client servers 110 simultaneously running play for pay and play for fun wagering games. The dual-purpose internet gaming platform is configured to run a play for pay wagering game and a play for fun wagering game according to an at least partially integrated architecture that manages player accounts. The play for pay wagering game enables a user to cash out from the player accounts, and the play for fun wagering game does not enable the user to cash out from the player accounts. Partial integration means that at least two of the servers of the gaming system 100 are shared for performing play for pay and play for fun features. For example, the game rules server 120 and the deck server 122 may be used to perform both play for pay and play for fun features. In some embodiments, full integration may be achieved for all servers of the gaming system 100 to perform play for pay and play for fun features. Of course, in some embodiments, the play for pay and the play for fun features may have their own separate gaming systems 100. In other words, each gaming system 100 may be configured as a single-purpose platform to run the play for pay and the play for fun features, if both sets of features are present. Other embodiments may include at least a partial integration of gaming systems 100 that run both play for pay and play for fun features, such that one or more servers are shared.

In some embodiments, the client servers 110 that run the play for pay features of the dual-use internet platform may be separate from the client servers 110 that run the play for fun features of the dual-purpose platform. For example, the dual-purpose internet gaming platform may receives function calls from different client servers 110 to run the play for pay wagering game and the play for fun wagering game. In other embodiments, the client servers 110 that run the play for pay and the play for fun features may be the same. For example, the client servers 110 may be configured to send functions calls associated with both the play for pay wagering game and the play for fun wagering game from the same client server 110.

Figure 1B:
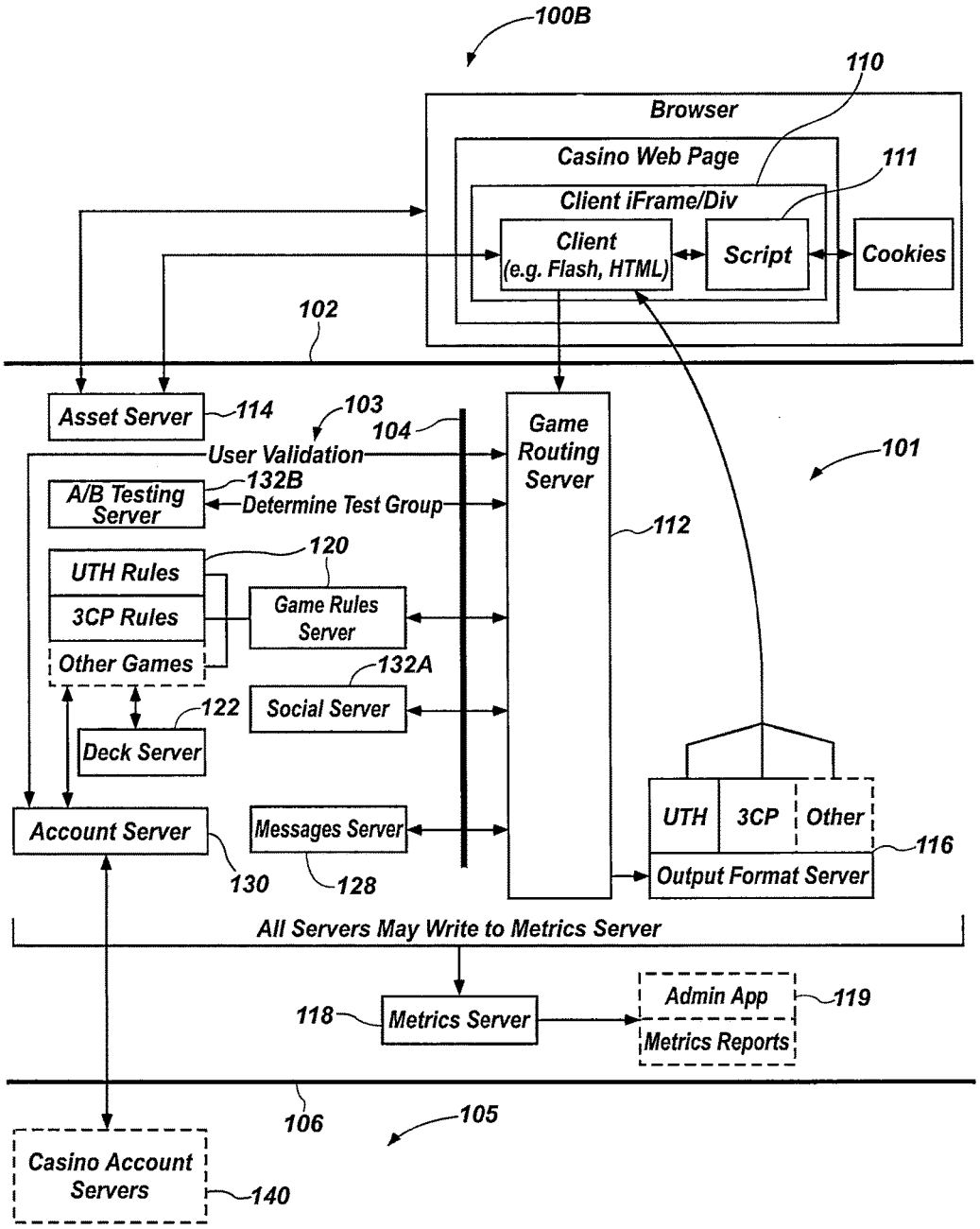
FIG. 1B is a schematic block diagram of a gaming system showing data flow according to an embodiment of the present disclosure.

FIG. 1B is a schematic block diagram of a gaming system 100B showing data flow according to an embodiment of the present disclosure. The gaming system 100B includes the various servers described above with respect to the gaming system 100A of FIG. 1A.

As discussed above, the client server 110 may communicate with the servers of the first sub-system 101, such as through the first firewall 102. For example, the client server 110 may be authorized to communicate with the game routing server 112, the asset server 114, the output format server 116, and the metrics server 118, whereas other servers may not be authorized for such communication. The asset server 114 may receive requests from the client server 110 for delivering assets to the client as discussed above. The game routing server 112 may receive instructions from the client server 110 related to playing a particular wagering game supported by the gaming system 100B. Communication from the game routing server 112 back to the client server 110 may flow through the output format server 116, which may be configured to prepare the data in an appropriate format to be processed by the end user device coupled with the client server 110. The client server 110 may include a client program embedded in a web page (e.g., casino web page) that is operable in a web browser. The client program may be supported by an inline floating frame (iFrame) or div elements. The client program may be written in an appropriate language such as HTML or Flash. As discussed above, the client server 110 may be provided with a relatively small amount of script 111 (e.g., JavaScript), also referred to as a "script driver," including scripting language that controls the interfacing of the client server 110 with the gaming system 100. The client server 110 may be a thin client to provide the client with the ability to communicate with the gaming system 100 by sending requests to the gaming system 100 rather than performing logic itself. In other words, the script 111 may merely include calls to functions that are externally defined.

As further discussed above, the game routing server 112 may communicate with the servers of the second sub-system 103, such as through the second firewall 104. For example, the game routing server 112 may be authorized to communicate with the game rules server 120, the messages server 128, the account server 130, and possibly the other servers 132, whereas non-authorized servers may not be permitted for such communication. In some embodiments, the deck server 122 may not be configured to communicate directly with the game routing server 112. Instead, the game rules server 120 may be authorized to communicate with the deck server 122.

The other servers 132 shown in FIG. 1B are the social server 132A and an A/B testing server 132B. The social server 132A may integrate features with various social media platforms (e.g., Facebook, Google Plus, Twitter, etc.). The A/B testing server 132B may develop testing groups for analysis of game play. The A/B testing server 132B may be responsible for multivariate testing to generate tests, such as to try out new features for the gaming system 100. Each test performed by the A/B testing server 132B may be defined by the percentage of users in each test group (including a control group). For example, when a user accesses the gaming system 100, the A/B testing server 132B may determine which group (if any) the user belongs to for running a test. If the user does not belong to a testing group, the user is randomly assigned to a testing group weighted by the desired percentage of users for each testing group. Each server of the gaming system 100 may operate differently according to which testing group the user belongs to according to what feature is being tested. The various servers of the gaming system 100 may query the A/B testing server 132B for the user's testing group and makes decisions based on the testing group of the user. For example, the asset server 114 may make a decision regarding which image to show or which audio file to play based on the testing group of the user. Other decisions that may be affected by different testing groups may include which pay table to use, or any logic that can be branched using a decision tree in the corresponding server of the gaming system 100.

The deck database server 124 and the archive server 126 are not shown in FIG. 1B, but may be included with the gaming system 100B to perform the functions described above with respect to FIG. 1A. The metrics server 118 may receive metrics data from each of the servers of the gaming system 100B (or the gaming system 100A for the embodiment of FIG. 1A). For example, the metrics server 118 may log metrics data for operations from each server of the first sub-system 101 and the second sub-system 103. The metrics server 118 may generate metrics reports for administrators to review, such as part of an administrator application 119.

The game routing server 112 may route information between the servers of the second sub-system 103 and the client server 110 during game play. The game rules server 120 may include rules for one or more wagering games, such as the Ultimate Texas Hold 'Em® (UTH) poker game, Three Card Poker (3CP) game, and other games. The wagering games may be card based, or non-card based as previously discussed. The game rules server 120 may communicate with the deck server 122 to generate the game piece indication as requested by the game rules server 120. The deck server 122 is configured to generate and output the game piece indication to the game rules server 120 in response to the request, such that the game piece indication is unavailable to the game rules server 120 until requested. In other words, the game piece indication information may not be available to the game rules server 120 until required for determining game outcome information at the desired time. For example, the deck server 122 may share the game piece indication information with the game rules server 120 after the game rules server 120 verifies that a proper wager has been made, and that advancing the game to the next decision by the player is appropriate, or that determining the final game outcome information is appropriate. Prior to such a determination, the deck server 122 may wait to provide such data to the game rules server 120. The verification of a proper wager may include the game rules server 120 communicating with the account server 130 to verify that the user account has sufficient funds to cover the wager.

As discussed above, the account server 130 may communicate with external accounts (e.g., casino account servers 140) that perform the actual maintenance of the user accounts, including executing debits, credits, and maintaining the funds of the end user. Thus, the casino account servers 140 and other external servers may be operated by one or more third parties to the gaming system 100B and may be considered part of a third sub-system 105, which may not be part of the gaming system 100B. In addition, the account server 130 may communicate with the casino account servers 140 and other external servers through a third firewall 106. In some embodiments, such as when a casino may operate the entire operations including the game play, content, client support, and account management and activity, the casino account servers 140 may be included as part of the gaming system 100B. The casino account servers and other external servers may be considered a third sub-system 105 of the gaming system 100B.

Figure 2:
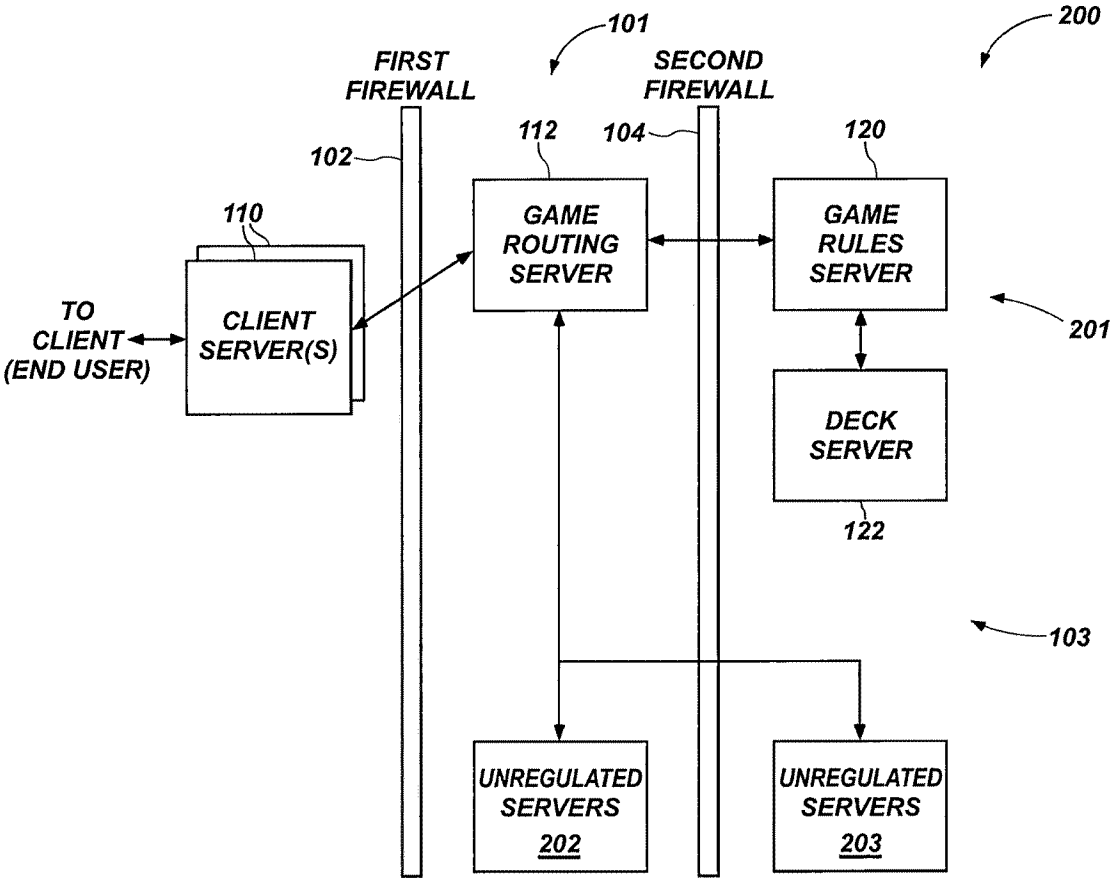
FIG. 2 is a schematic block diagram of a gaming system according to an embodiment of the present disclosure.

FIG. 2 shows a gaming system 200 according to an embodiment of the present disclosure. The gaming system 200 shows the separation of regulated servers 201 and unregulated servers 202, 203. That is, the regulated servers 201 include servers that are anticipated to be subject to gaming authority regulation, while unregulated servers 202, 203 are not anticipated to be subject to such regulation. The regulated servers 201 may include certain functions such as those described by client server 110, the game routing server 112, the game rules server 120, and the deck server 122. Prior to launch of gaming system 200, government regulators may investigate the functionality of these regulated servers 201 to ensure that applicable laws and regulations are complied with. Reconfigurations or updates to any of these servers may require further regulatory approval.

The unregulated servers 202, 203 may include one or more of the asset server 114, the output format server 116, the metrics server 118, the deck database server 124, the archive server 126, the messages server 128, the account server 130, and other servers 132, which are individually shown and described with respect to FIG. 1A. The unregulated servers 202, 203 may be updated without regulatory impact as opposed to conventional methods that combine regulated functions and unregulated functions within the same server. For example, if the functionality of the asset server 114 were combined with the game rules server 120, regulatory approval would be required for updating that server just to include a new image for a game. As a result, the time and costs associated with receiving regulatory approval may be substantially reduced by segregating functions of different servers. Of course, it is contemplated that laws and regulations may change over time and according to jurisdiction, such that the functions described herein as requiring regulation may not need regulation in the future, and vice versa.

The embodiments of the present disclosure are described in terms of the various servers of the gaming system 100 (FIGS. 1A, 1B), 200 (FIG. 2) being separated from each other. Discussion of having a separate (i.e., different) server is not to be understood as requiring physical separation of each server, but rather, as being logically separated from each other. Of course, physical separation and differentiation of one or more of the servers is contemplated as an embodiment of the present disclosure. In other words, one or more of the servers may be a physically separate server that communicates with the other physically separate servers.

That is, each physically separate server may include its own processor and associated memory, such that the memory is specifically programmed to control the processor to execute instructions that perform the functionality and inter-communication described herein. In some embodiments, the functionality of one or more servers may share physical resources, such as being hosted by one or more shared physical servers. In other words, physical hardware (e.g., processor, memory, etc.) may be shared; however, the data and functionality of the different servers of the gaming system 100 may remain logically separate. As a result, the separate data, firewalls, communication links, and other relationships between the various servers of the gaming system 100, 200 may remain intact without compromising the security and scaling benefits described herein. In fact, using shared physical resources may even further enhance the scaling benefits as the gaming system 100, 200 reaches certain levels of growth. As an example, the various servers of the gaming system 100, 200 may be configured according to a cloud architecture (i.e., using principles of cloud computing as understood by those skilled in the art). Therefore, the general term "server" includes physical servers as well as virtual servers that may share physical resources of one or more physical servers.

Figure 3:
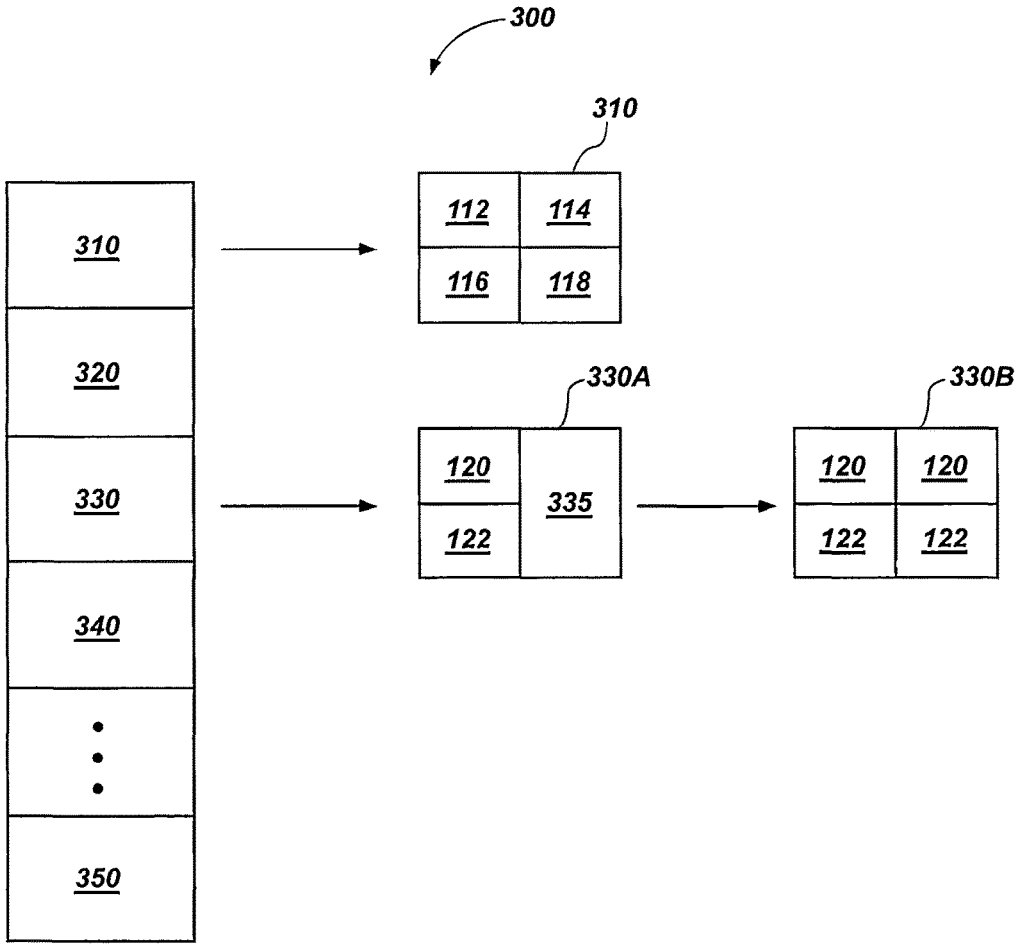
FIG. 3 is a server architecture of a gaming system with the various servers of the gaming system sharing physical resources according to an embodiment of the present disclosure.

FIG. 3 is a server architecture 300 of a gaming system (e.g., gaming system 100, 200) with the various servers of the gaming system sharing physical resources according to an embodiment of the present disclosure. The server architecture 300 includes a plurality of servers 310, 320, 330, 340, 350 that are configured to host the various server functions of the gaming system 100, 200 that is described above with respect to FIGS. 1A, 1B, and 2. For example, the plurality of servers 310, 320, 330, 340, 350 may generate instances of virtual servers that share physical resources, such as part of a cloud computing architecture. While five servers are shown in FIG. 3, any number of servers is contemplated according to the capacity needs of the gaming system. It is to be understood that a "virtual server" falls within the definition of the term "server" for purposes of this disclosure.

Each of the various server functions of the gaming system may be hosted by at least one of the plurality of servers 310, 320, 330, 340, 350; however, only a portion of the various servers of the gaming system is actually shown, for convenience. For example, only the game routing server 112, the asset server 114, the output format server 116, the metrics server 118, the game rules server 120, and the deck server 122 are shown. It should be understood, however, that the plurality of servers 310, 320, 330, 340, 350, as a whole, host the other servers of the gaming systems described above. In addition, each of the plurality of servers 310, 320, 330, 340, 350 are to be understood as being physical servers of the server architecture 300, whereas the servers (e.g., 112, 114, 116, 118, 120, 122, and others) of the gaming system are to be understood as "virtual servers." That is, the server architecture 300 generates instances of the servers of the gaming system to have the relationships with each other as described above. For example, a first server 310 may generate virtual servers (i.e., instances) for the game routing server 112, the asset server 114, the output format server 116, the metrics server 118, while a third server 330 may generate virtual servers for the game rules server 120, and the deck server 122. The other servers (e.g., second server 320, fourth server 340, fifth server 350, and so on) may generate and host virtual servers for the other server functions of the gaming system. When the virtual servers are generated, the server architecture 300 does so according to the communication rules and logical separation set by the architecture rules. As a result, the various servers of the gaming system may share physical resources with each other while still maintaining the logical separation and communication relationships described above.

The specific configuration shown is to be understood as an example of one embodiment, and individual server functions may be combined within the same physical server according to any combination of the various servers of the gaming system. For example, even through the first server 310 is shown to generate virtual servers for the game routing server 112, the asset server 114, the output format server 116, the metrics server 118, another combination may include another combination such as the account server 130, the game routing server 112, the game rules server 120, the deck server 122, and the messages server 128. Thus, virtual servers for the first sub-system 101 may be combined with virtual servers for the second sub-system 103. Therefore, each of the physical servers 310, 320, 330, 340, 350 may generate and host virtual servers of any number or combination according to the capacity of the server.

During operation of the gaming system, the usage may vary such that one or more of the individual virtual servers may fluctuate in needed capacity. For example, at one point in time, the third server 330A may host a single instance each of the game rules server 120 and the deck server 122. At this point in time, the third server 330A may have unused server space 335 that is available for use, if needed. At another point in time, the usage of the gaming system may increase. The server architecture 300 may determine that another instance for each of the game rules server 120 and the deck server 122 is needed to meet the increased usage demand of the gaming system. As a result, the third server 330B may generate another instance for each of the game rules server 120 and the deck server 122 to occupy the unused server space 335 during that time of increased demand. As usage fluctuates over time, the server architecture 300 may increase and decrease the number of instances of the virtual servers for the gaming system to adjust in real time to the demands of the gaming system.

Figure 6:
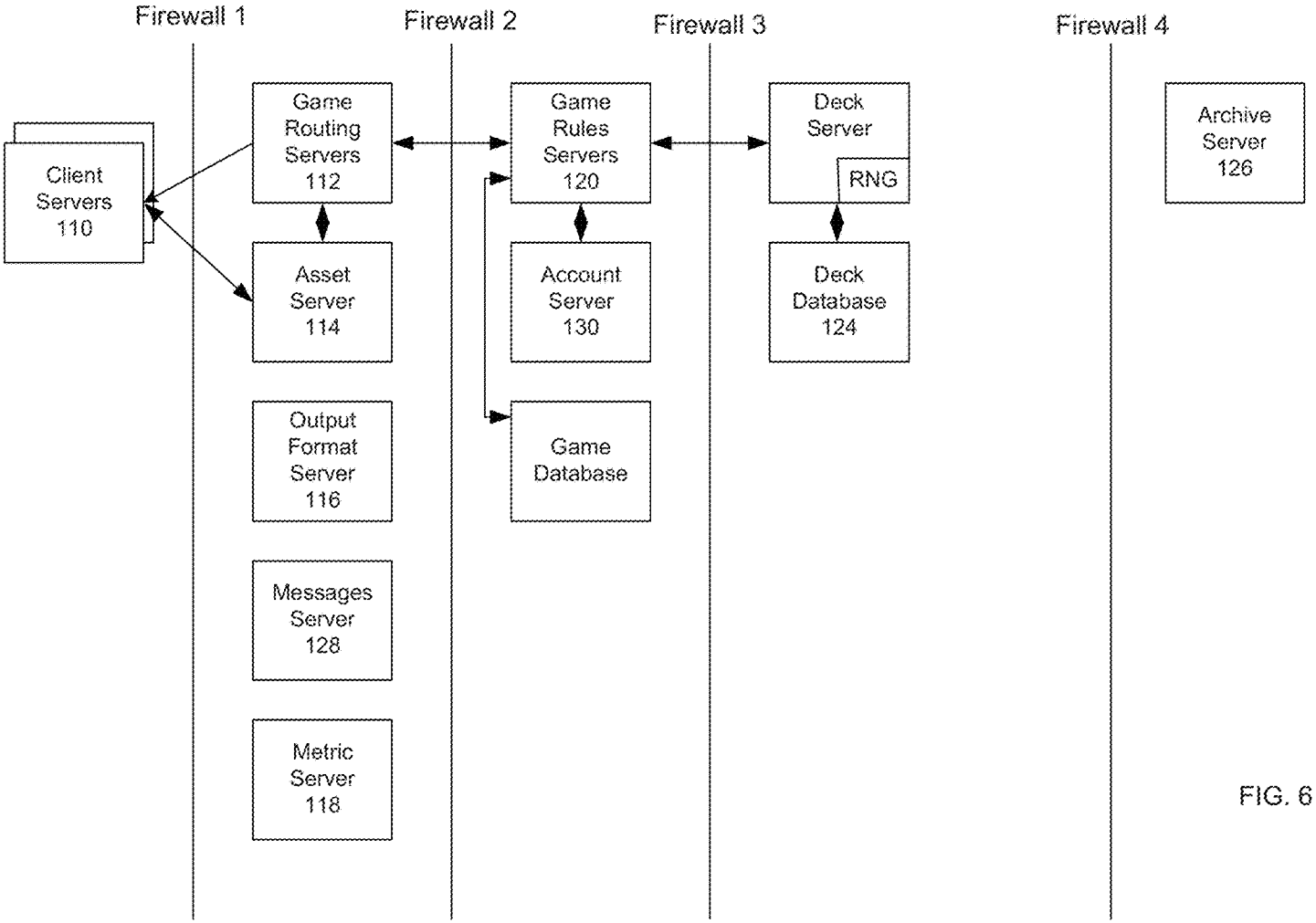
FIG. 6 is a schematic block diagram of a gaming system according to an embodiment of the present disclosure.

FIG. 6 is a schematic block diagram of a gaming system according to an embodiment of the present disclosure. A concern with conventional gaming architectures is the possibility of a person with access to multiple servers gaining access to sensitive game information which can enable cheating/collusion. A feature of an embodiment of the present disclosure is the addition of additional firewalls, encryption and/or additional security to prevent access by a person to multiple pieces of sensitive information that can be used to compromise the integrity of the gaming system and method. In the embodiment shown in FIG. 6 a first firewall separates clients servers 110 from game routing servers 112, asset server 114, output format server 116, metric server 118 and messages server 128. The first firewall prevents unauthorized access of gaming devices/information, e.g., game routing servers 112, asset server 114, from external devices, e.g., client servers 110.

A second firewall is positioned between game routing servers 112, asset server 114, output format server 116, metric server 118 and messages server 128 and game rules servers 120, account server 130 and game database 135. The game database 135 includes rules and other game information for multiple games. The game database 135 can provide the game rules servers 120 with such gaming rules and information. In another embodiment the game rules server 120 is isolated by one or more additional firewalls (not shown) such that communication between the games rules server and the account server 130 and/or game database 135 is through a firewall. Some protection of the first and second firewalls can be described as a game routing server firewall which provides firewall protection for the game routing server from communication coming from any other source. For ease of discussion, the description of separate firewalls, e.g., Firewalls 1-4, can also be described as firewalls for a particular device, e.g., game rules servers firewall, deck server firewall. In embodiments, the game routing server firewall can also provide firewall protection for multiple devices within firewall 1 and firewall 2, e.g., asset server 114, output format server 116, messages server 128 and/or metric server 118. Similarly a game rules servers firewall can provide protection for multiple devices within firewall 2 and firewall 3. Similarly a deck server firewall can provide protection for multiple devices within firewall 3 and firewall 4, e.g., deck server 122 and deck database 124.

A third firewall is positioned between the game rules servers 120, account server 130 and game database 135 and the deck server 122 and deck database 124. This firewall separates the game rules servers 120 from the deck sever 122. As described herein, during online game play, the game rules servers 120 request random game pieces, e.g., cards, from the deck server 122. This third firewall helps prevent a single person from accessing both the game rules servers 120 and the deck server 122. This prevents a person with access to the game rules server 120 from accessing game pieces, e.g., cards, that haven't yet been "shown" to the player during a time where the unauthorized access could compromise the integrity of the game by, for example, communicating future card information to a player which may affect a player's bet. In another embodiment the deck server 122 is isolated by another firewall (not shown) from the deck database 124.

A fourth firewall is positioned between the deck server 122 and deck database 124 and the archive server 126. In an alternate embodiment another firewall is positioned between the deck server 122 and the deck database 124.

The architecture of these embodiments hinder the ability of a person from compromising the integrity of the game by having firewall protection between the various components of the online gaming system.

The type of firewall can include any conventional firewall system. For example, the firewalls can include whitelists that are lists or registers of entities, e.g., servers, from which communication will be accepted. For example, one or more game rules server 120 may be identified as being acceptable entities/devices with which a deck server 122 can communicate. Accordingly Firewall 3 will permit such communications. Similarly a game routing server 112 may be white listed by Firewall 2 to communicate with game rules server 120 which enables the game rules server 120 and the game routing server 112 to communicate. Other firewall strategies can be used in conjunction with or in place of whitelisting. For example, a blacklist is a list of entities that are not permitted to communicate through the firewall. Other firewall protection strategies can also be used in one or more of the firewalls.

As described above, separating the gaming functions into various components provides an additional scaling benefit. For example, the game routing server 112 may be scaled (e.g., the number of servers may be increased) to handle different games as new wagering games are released and supported by the gaming system 100 with the addition of additional game rules servers 120. Thus, a plurality of game rules servers 120 may share the game routing server 112. As a result, the more games that are added to the system, the more the cost per player per game may be reduced because resources will be shared among games. Also, as the number of clients and client servers 110 increase, the number of game routing servers 112 may be increased. This approach of scaling individual servers according to need for that particular function is unlike that of conventional gaming systems, which tend to duplicate server resources for individual games. The separation of functions in the present embodiments enables greater equipment and hosting cost savings since distinct elements can be scaled as necessary instead of requiring an additional complete system. Also scaling can be done to devices performing non-regulated functions, e.g., the asset server 114, easily and quickly since such a device need not go through an expensive compliance process performed by gaming authorities, e.g., governmental gaming regulating authorities.

In an embodiment, data encryption is also used to enhance the game integrity. In an embodiment, communications between the game routing servers 120 and the game rules servers 120 are encrypted. In another embodiment communication between the game rules severs 120 and the deck server 122 is encrypted. In another embodiment communication between the game deck sever and the archive server 126 is encrypted. In embodiments combinations of such encrypted communications can be used. In embodiments, communication between other devices is also encrypted, e.g., communication between the game rules servers 120 and account server 130.

The type of encryption can include any conventional encryption algorithm. In one embodiment communications between some or all of the devices shown in FIG. 5 use encryption. In some embodiments encryption is used as a supplement to Firewall protection between devices. One type of encryption uses a "salt" which can be a set of random bits which is used to create one of the inputs to an encryption algorithm. In an example, requests from the Game rules servers 120 to the deck server 122 include a salt which is used by the deck server 122 when encrypting the response, e.g., the cards that are requested. For example, a symmetric key encryption process is used in an embodiment in which a deck server encrypts a request using a key, e.g., Key G. Key G is generated using a first key (Key 1) and a first salt (Salt 1). Every game may have its own salt value. The encrypted request may be received by the deck server 122 which can determine the value of Salt 1 since Key 1 is known in a symmetric key encryption system. The deck server 122 can then generate a response which is encrypted using a key, e.g., Key D. Key D may be generated using a second key (Key 2), a second salt (Salt 2) and also the first salt value (Salt 1). The response encrypted using Key D is sent to the game rules server 120 and decrypted. Examples of encryption algorithms include DES (data encryption standard) and AES (advanced encryption standard). This additional encryption and salting provides additional security to the gaming system.

Figure 7:
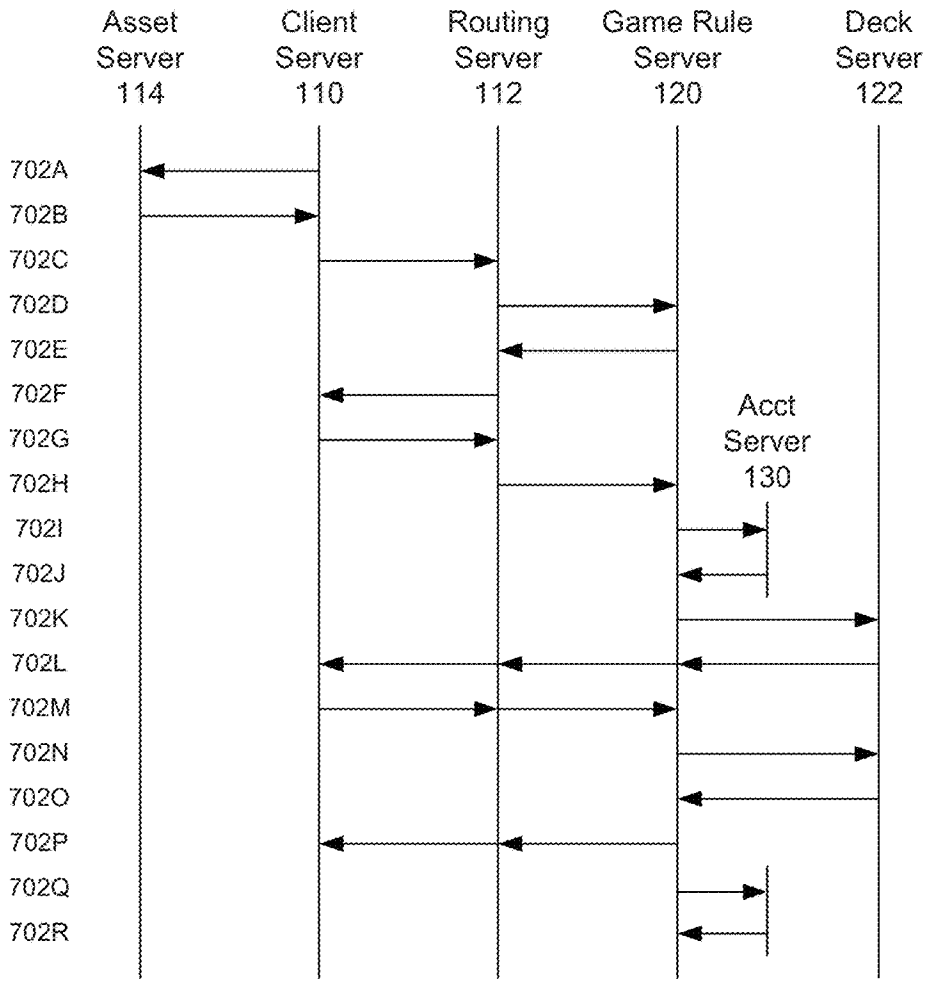
FIG. 7 is a diagram of data flow according to an embodiment of the present disclosure.
Figure 8:
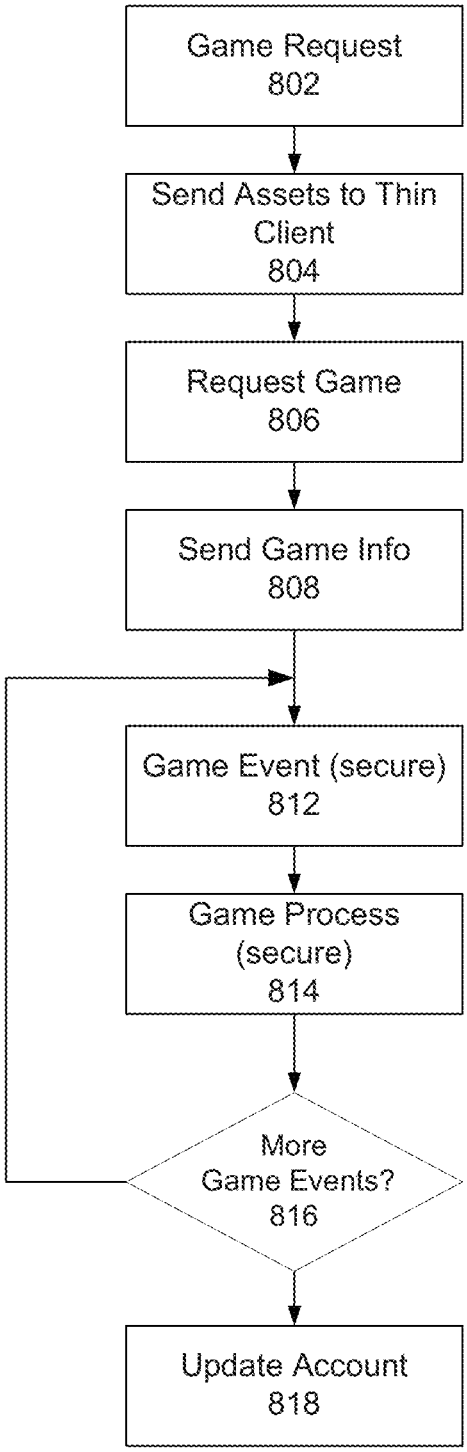
FIG. 8 is a flow chart illustrating a method of enabling the play of on-line wagering games according to an embodiment of the present disclosure.
Figure 9A:
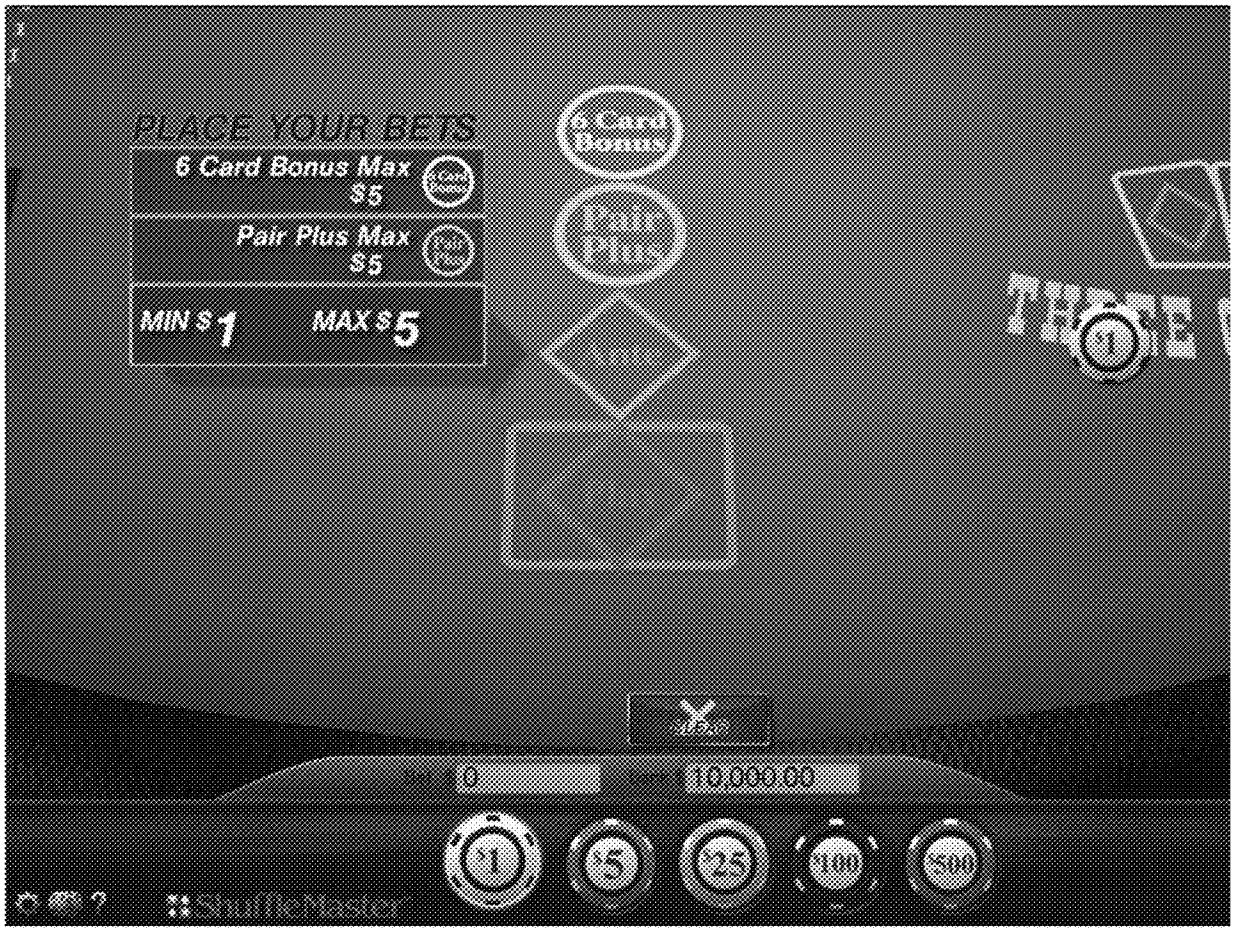
FIGS. 9*a*-9*e* are illustrations of a user interface of a game of three card poker in accordance with an embodiment of the present disclosure.

FIG. 7 is a diagram of data flow according to an embodiment of the present disclosure. FIG. 7 will be discussed with reference to FIG. 8 and FIG. 9. FIG. 8 is a flow chart illustrating a method of enabling the play of on-line wagering games according to an embodiment of the present disclosure. FIGS. 9*a*-9*e* are illustrations of a user/player interface of a game of three card poker in accordance with an embodiment of the present disclosure. A game request 702A is sent 802 from the client server 110 to the asset server 114. The asset server 114 sends 804 game assets (asset manifest) 702B to the client server 110. For example, if the game request 702A is for a game of Three Card Poker (TCP)

the assets can be an image of a TCP table including bet locations. An example of this is set forth in FIG. 9*a*. In FIG. 9*a* assets are shown as a user interface having locations where a player can place bets, i.e., Play, Ante, Pair Plus, 6 Card Bonus. In addition, various denominations of chips are shown ($1, $5, $25, $100, $500 in this example) which can be selected by a player when placing bets. As described above, asset data may include image data, audio data, video data, and other similar data that may be used by a particular wagering game. A benefit of having the asset server separated from game servers, e.g., game routing server 112, game rules servers 120, deck server 122, is that it permits modification to the look of the game without needing to go through an expensive and time-consuming gaming compliance procedure.

In the signaling sequence shown in FIG. 7, the client server 110 requests 806 a new game 702C from the routing server 112. The routing server 112 identifies the appropriate game rules server 120 and sends a game request 702D to the game rules server 120. The game rules server 120 identifies the game, the rules and starts a new instance of the game, e.g., Three Card Poker. The game rules server 120 sends 808 the game information [Andrew, what is sent here?] 702E to the routing server 112. The routing server 112 then sends the game information and a client script request 702F to the client server 110.

Figure 9B:
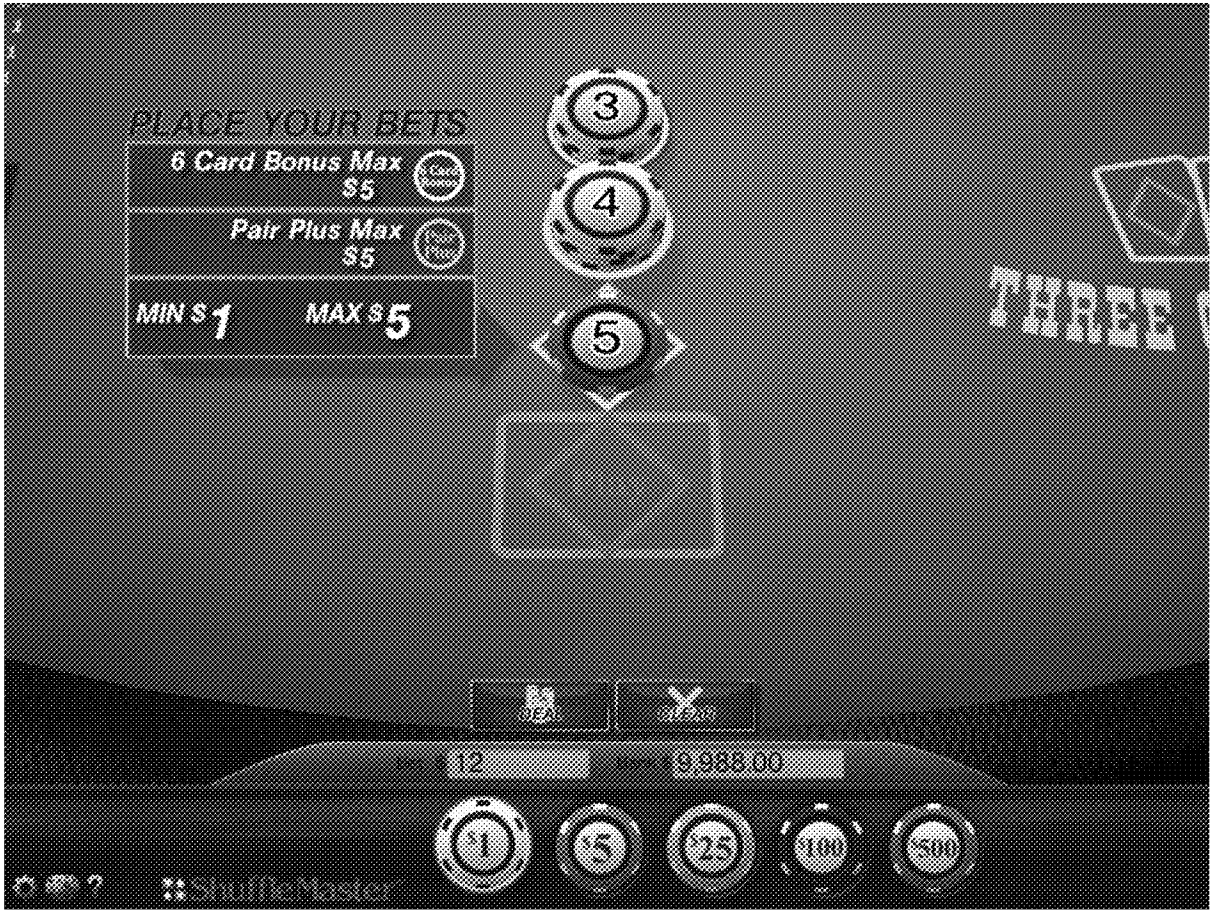

The client script request 702F can be executed by the client server 110 to permit the player to perform the next game event. As described above, in an embodiment the client server 110 is a "thin client" so that it execute scripts instead of having rule information stored within. In the Three Card Poker example, as shown in FIG. 9*b*, the player places an "Ante" bet by selecting one or more of the chips and placing them on the "Ante" area in the user interface. The player may optionally also place a bet in the "Pair Plus" and/or "6 Card Bonus" areas. In the example illustrated in FIG. 9*b*, the player has placed a $5 Ante bet, a $4 Pair Plus bet and a $3 "6 Card Bonus" bet. The player has the option to clear the bets by selecting "Clear" in FIG. 9*b* and in some embodiments an "Undo Last" option enables the player to undo the last chip placed. When the player has completed betting, the player selects "Deal" by, for example, placing a cursor over the "Deal" area of the user interface and clicking on a mouse, track pad or other selection device.

The game of Three Card Poker includes multiple modes of play, the player's Ante and Play bets are in competition with the player's hand against the dealer's hand. A Pair Plus bet is paid on a pay scale basis that the player hand will be a pair or better. A Six Card Bonus bet is paid on a pay scale basis based on a player using the player's three cards and the dealer's three cards to make the best possible five card poker hand. In some embodiments, the Ante, Pair Plus and Six Card Bonus are optional, but in some embodiments the Ante is mandatory. After all Ante, Pair Plus and Six Card Bonus bets are placed, three cards are dealt to each player and later to the dealer. Players that have placed the Ante bet have a choice to either fold or continue in the game by placing a Play bet equal to the Ante. In an embodiment the dealer's cards are then identified and the hands are then exposed and bets resolved. The dealer hand must be Queen high or better for the dealer hand to play. If the dealer does not play then there is no action on Play bets and Ante bets are paid 1 to 1. If the dealer does play the dealer and player hands are compared. If the player hand loses, both the Ante and Play bets lose. If the player hand wins, both the Ante and Play bets are paid 1 to 1. If the hands are tied then there is no action on the Ante and Play bets. The Pair Plus bet loses if the player has less than a pair and wins with a pair or better. The payoff applies regardless of the dealer hand as the Pair Plus bet is not in competition against the dealer hand.

After a bet has been entered the client server 110 sends 812 that game event, e.g., bets, 702G to the routing server 112. The router server 112 sends the game event 702H to the game rules server 120. The game rules server 120 performs a variety of functions, it confirms that legal bets were placed, e.g., that all bets are between the minimum and maximum bets were placed and that an Ante bet was placed. If an illegal bet was made the game rules server 120 will send an error message (not shown) to the routing server 112 which will send a script to the client server 110 in order to alert the player that a bet was not legal. The game rules server 120 may also contact an account server 130 to request 7021 confirmation that the player has sufficient funds to cover the bets. The account server 130 sends a message 702J back to the game rules server 120 with player account information. If there are not sufficient funds to cover the bet, the games rules server 120 will send a message (not shown) to the routing server 112 which will send a message/script to the client server 110 to provide an error message to the player.

If the game event, e.g., bets and account information, are legal then the game proceeds. The game rules servers 120 sends 814 a game process request 702K to the deck server 122. The deck server 122 can use a previously generated deck or can generate a deck in real-time and sends the game information, e.g., cards, that are necessary for the first portion of the game to the game rule server 120. For Three Card Poker, the deck server 122 sends card information 702L only for the three player "Up" cards. The deck server may also send pointers or references to the dealer's down cards, but, in embodiments, the values of the dealer's down cards are not sent to the game rules server 120 in order to reduce the ability of cheating/collusion. By not sending the value of the dealer's down cards there is no ability for a person with access only to the game rules server 120 to collude with a player since the only definitive information available at the game rules server is information that will be available to the player prior to the player making another decision.

That is, in embodiments, the values of game pieces generated in the deck server 122 are not sent to the game rules server 120 until after the game rules server 120 has received all user activity, e.g., bets, that can be done (placed) prior to receiving the value of the game pieces. For example, the deck server 122 does not send the value of the three player Up cards until after the user places all pre-deal bets, e.g., the Ante, Pair Plus and/or 6 Card Bonus bets in the Three Card Poker example. Similarly, the value of the dealers' cards are not sent from the deck server 122 to the game rules server 120 until the game rules server 120 has received all bets that are possible prior to receiving the value of the game pieces, e.g., the Play bet in the Three Card Poker example.

The game rules server 120 sends the card information 702L to the routing server 112 which sends the information to the client server 110. In the example shown in FIG. 9*c*, the player's up cards are shown and are the 9 of spades, 9 of clubs and 3 of spades.

Figure 9C:
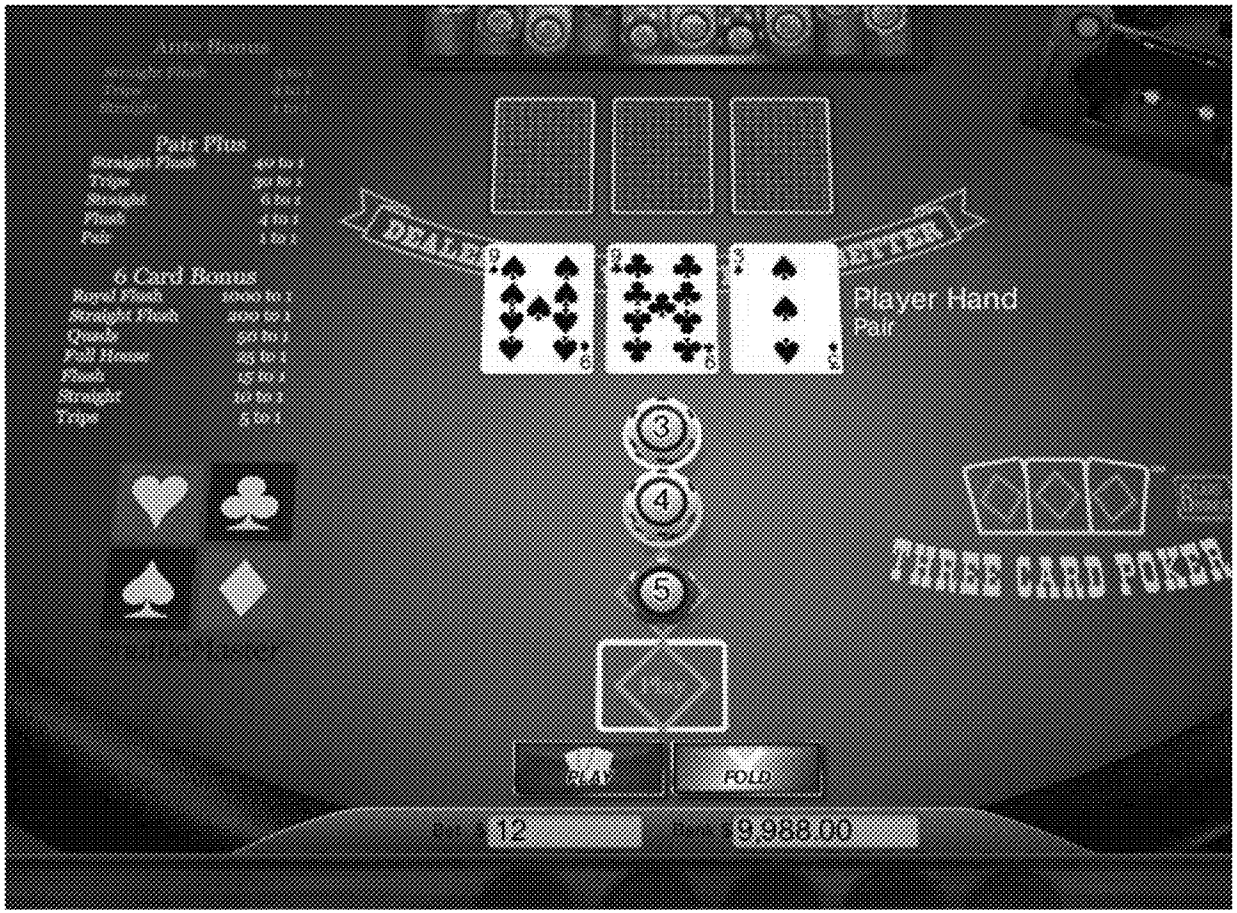

After the player's cards are shown, the player has the option of playing, by placing a bet on Play in an amount equal to the Ante bet, or folding, in which case the player forfeits the Ante bet. As shown in FIG. 9*c*, the player can select to continue playing by placing a $5 bet the Play bet area, then selecting "Play." Alternatively the player may fold by selecting "Fold." In this example, the player continues playing.

If 816 there are more game events, e.g., more bets, the process repeats beginning with step 812. With reference to FIG. 7, the game event information 702M is sent 814 from the client server 110 to the routing server 112. The routing server sends the game event information 702M to the game rules server 120. The game rules server may recheck the account information with the account server 130 to ensure the player has sufficient funds (not shown). The game rules sever sends a request 702N for additional game pieces, e.g., dealer cards, to the deck server 122. The deck server may have previously determined the three dealer cards or may determine them after receiving request 702N. The dealer card information 702O is sent to the game rules server 120. The game rules server then determines the outcome of the game and sends the dealer card information along with the game resolution information 702P to the routing server 112 which sends the dealer card information/game resolution information 702P to the client server 110.

Figure 9D:
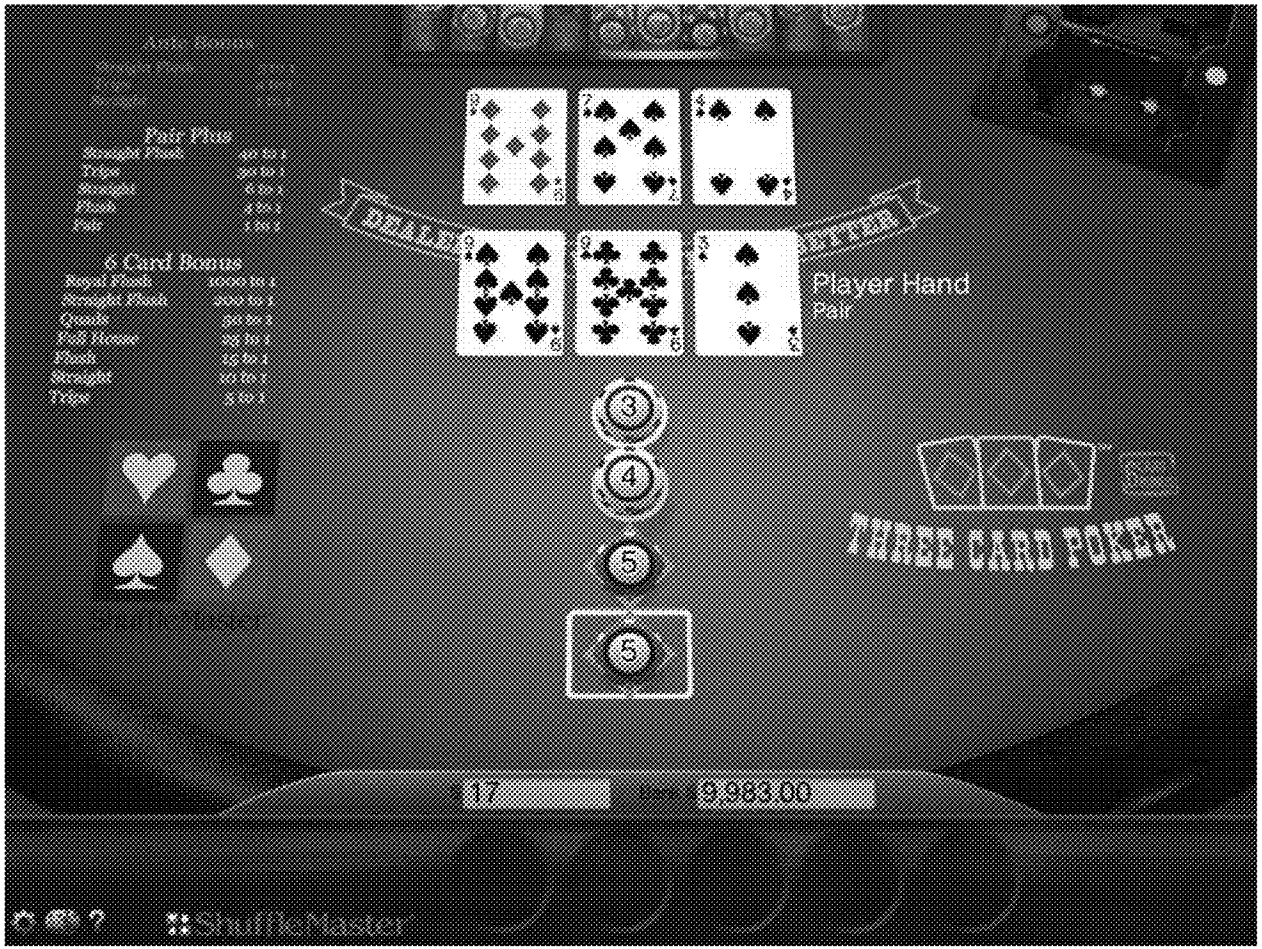
Figure 9E:
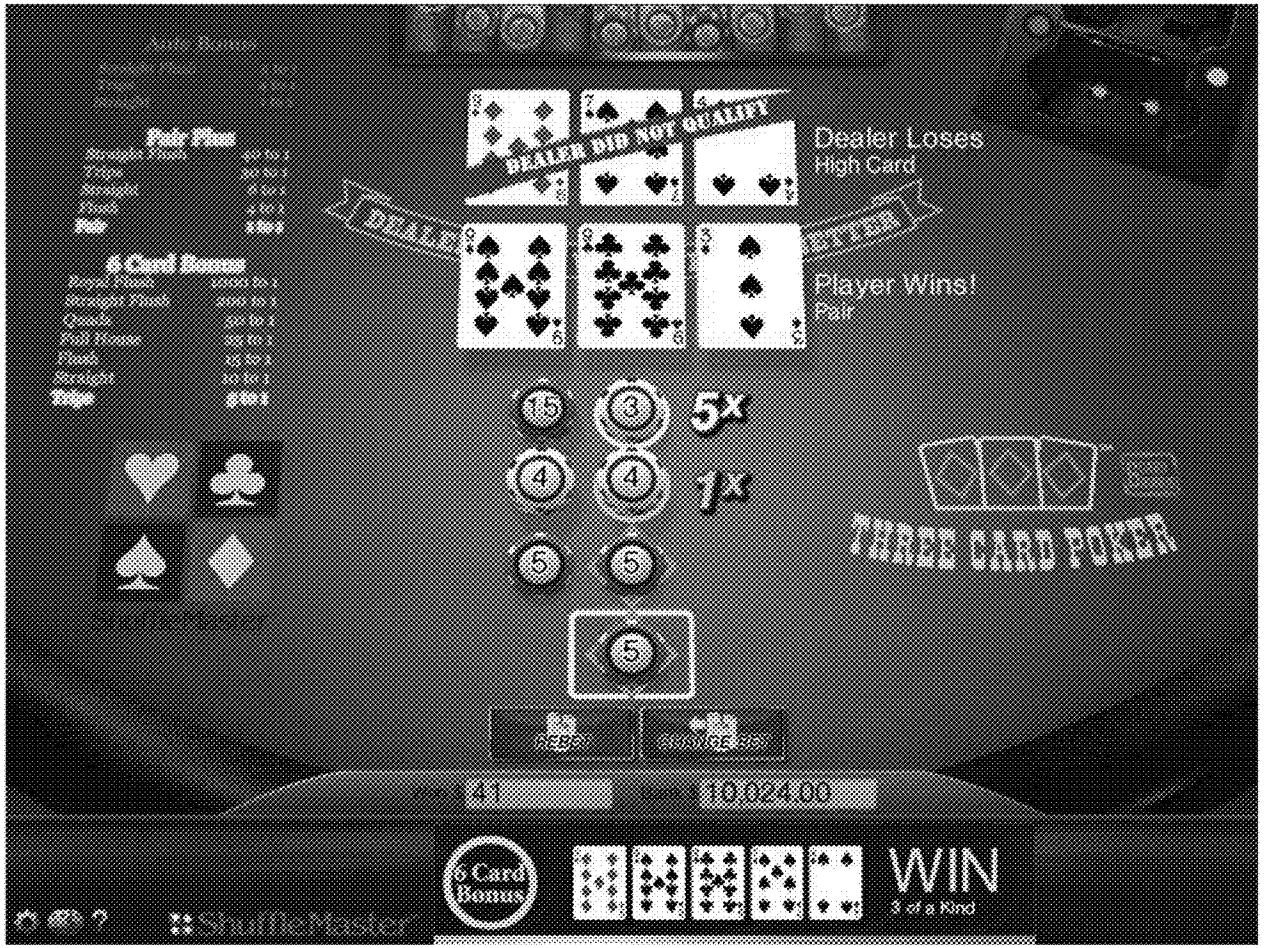

As shown in FIG. 9*d*, the dealer's cards are shown, in this example the dealer's cards are 9 of diamonds, 7 of spades and 4 of spades. The resolution of the game is then showed for the various bets. As shown in FIG. 9*e*, the dealer does not qualify therefore the player wins the Ante bet (paid 1:1) and the Play bet is returned. The player has a pair of 9s therefore the player wins the Pair Plus bet (paid 1:1). For the 6 Card Bonus bet, the bet five card poker from the six cards is three 9's ("Trips") which pays 5:1.

In an embodiment, the game rules server 120 contacts the account server 130 to credit 702Q the player's winnings to the player's account and the account server 130 sends a confirmation message 702R. In other embodiments, the account server 130 is contacted after a player session of multiple games is complete. The account server 130 may be contacted at different frequencies in different embodiments.

CONCLUSION

Embodiments of the present disclosure include a gaming system for enabling secure on-line gaming through a client server. The gaming system comprises a gaming platform to communicate with a client server to support play of a wagering game by an end user/player. The gaming platform comprises a game rules server configured to administer a set of game rules for the wagering game, and a deck server to randomly select game pieces according to the set of game rules.

Another embodiment of the present disclosure includes a network gaming architecture. The network gaming architecture comprises a plurality of regulated servers that require validation from gaming authorities for reconfiguration of each of the plurality of regulated servers, and at least one unregulated server that does not require validation from gaming authorities for reconfiguration of the at least one unregulated server. The regulated servers include a game rules server storing game rules for a wagering game, and a deck server coupled with the game rules server. The deck server is configured to randomly select game pieces for the wagering game in response to requests received from the game rules server. The at least one unregulated server is configured to support an additional function of the gaming system.

Another embodiment of the present disclosure includes a client server for accessing a remote gaming engine, the client server comprising a computer readable medium having instructions stored thereon. When executed by a processor, the instructions cause the processor to establish a communication link with a remote gaming engine to execute a wagering game, and receive inputs from an end user and transmit the inputs to the remote gaming engine during play of the wagering game. The client server acts as a thin client to the remote gaming engine such that the remote gaming engine performs game play processing.

In another embodiment of the present disclosure, a method of enabling the play of on-line wagering games is disclosed. The method comprises providing code on an external client server to enable access to an on-line wagering platform having a game rules server and a deck server, receiving at least an indication of a placed wager from the external client server, randomly generating at least one number in the deck server, the at least one number used for selecting a virtual game piece for an on-line wagering game, determining a game outcome on the on-line wagering platform according to game rules stored in the game rules server, and transmitting the game outcome information to the external client server.

In another embodiment of the present disclosure, a dual-purpose internet gaming platform is configured to run both a play for pay wagering game and a play for fun wagering game according to an at least partially integrated architecture that manages player accounts. The play for pay wagering game enables a user to cash out from the player accounts, and the play for fun wagering game does not enable the user to cash out from the player accounts.

In another embodiment, a system for the provision of gaming over a network is disclosed. The system comprises a game rules server configured to receive an input associated with a game and to output a game outcome based on one or more game rules and a game piece indication, and a deck server separate from, and in communication with, the game rules server. The game rules server is further configured to request the game piece indication from the deck server. The deck server is configured to generate and output the game piece indication to the game rules server in response to the request, such that the game piece indication is unavailable to the game rules server until requested.

In another embodiment, a method for the provision of gaming over a network is disclosed. The method comprises receiving, at a game rules server, an input associated with a game. The method further comprises outputting, from the game rules server, a game outcome based on one or more game rules and a game piece indication. The method further comprises requesting, at the game rules server, the game piece indication from a deck server, and generating and outputting the game piece indication to the game rules server from the deck server in response to the request, such that the game piece indication is unavailable to the game rules server until requested, wherein the deck server is separate from and in communication with the game rules server.

Another embodiment includes a gaming system for enabling secure on-line gaming through a client server. The gaming system comprising a gaming platform to communicate with a client server to support play of a wagering game by an end user. The gaming platform includes a game engine configured to administer a set of game rules for the wagering game and to randomly select game pieces according to the set of game rules, and a game routing server separate from the game engine. The game routing server is configured to route communication between the client server and the game engine.

While the present disclosure has been described herein with respect to certain illustrated embodiments, those of ordinary skill in the art will recognize and appreciate that the present disclosure is not so limited. Rather, many additions, deletions, and modifications to the illustrated and described embodiments may be made without departing from the scope of the invention as hereinafter claimed along with their legal equivalents. In addition, features from one embodiment may be combined with features of another embodiment while still being encompassed within the scope of the invention as contemplated by the inventors.

What is claimed is:

1. A method, comprising:

receiving, from a client device associated with a player and via one or more first electronic communications sent over one or more computer networks to an external client server of a gaming platform having a plurality of servers, a first request to play a game via the one or more computer networks;

transmitting, based at least in part on the received first request and via one or more second electronic communications sent over the one or more computer networks, information indicative of a second request to a deck server of the gaming platform for game pieces selected by the deck server according to a set of game rules for said game;

receiving, based at least in part on the second request and via one or more third electronic communications sent over the one or more computer networks, information indicative of the selected game pieces from said deck server;

generating, by a game rules server of the gaming platform and based at least in part on the selected game pieces and on the set of game rules, a game outcome for said game, the generating of the game outcome including transmitting one or more fourth electronic communications indicative of the generated game outcome over the one or more computer networks to the external client server of the gaming platform;

allocating to the player, by the gaming platform and based at least in part on at least one of a number of rounds of said game completed by the player and a duration of game play of said game by the player, a first number of achievable elements that are exchangeable by the player to unlock additional features of said game that affect a game play of said game but that do not affect the game outcome of said game, wherein said achievable elements do not affect the game outcome of said game; and incrementing, by the game rules server of the gaming platform, the allocated first number of achievable elements to a set of achievable elements associated with the player;

wherein the first request is associated with a game wager amount for said game, wherein the generated game outcome determines a win or loss of the game wager amount, and wherein the allocating of the first number of achievable elements is not based on a separate wager from the associated game wager amount.

2. A gaming system for enabling a secure online gaming environment that supports network-based play of at least a first game, the gaming system comprising:

a gaming platform configured to support a play of the first game via one or more computer networks, wherein the gaming platform includes:

a game rules server that, in operation, administers a set of game rules for the first game via the one or more computer networks; and a deck server that, in operation, randomly selects one or more game pieces from a plurality of available game pieces in accordance with the set of game rules for the first game in response to one or more electronic communications generated by the game rules server;

wherein the game rules server, in operation, generates a game outcome for the first game based at least in part on the selected game pieces and the set of game rules for the first game; and wherein the gaming platform, in operation, allocates a first number of achievable elements to an end user based at least in part on at least one of a quantity of game outcomes generated for the end user with respect to the first game and a duration of game play of the first game by the end user, the achievable elements exchangeable by the end user to unlock additional features of the first game, wherein the additional features of the first game affect game play of the first game but do not affect any generated game outcome of the first game, and wherein the achievable elements do not affect any generated game outcome of the first game;

wherein play of the first game is associated with a game wager amount, wherein the generated game outcome includes an indication of a win or a loss of the game wager amount, and wherein the allocated first number of achievable elements is not based on any wager other than the associated game wager amount.

3. A method, comprising:

receiving, from a client device associated with a player and via one or more first electronic communications sent over one or more computer networks to an external client server of a gaming platform having a plurality of servers, a first request to play a game via the one or more computer networks;

transmitting, based at least in part on the received first request and via one or more second electronic communications sent over the one or more computer networks, information indicative of a second request to a deck server of the gaming platform for game pieces selected by the deck server according to a set of game rules for said game;

receiving, based at least in part on the second request and via one or more third electronic communications sent over the one or more computer networks, information indicative of the selected game pieces from said deck server;

generating, by a game rules server of the gaming platform and based at least in part on the selected game pieces and on the set of game rules, a game outcome for said game, the generating of the game outcome including transmitting one or more fourth electronic communications indicative of the generated game outcome over the one or more computer networks to the external client server of the gaming platform;

allocating to the player, by the gaming platform and based at least in part on at least one of a number of rounds of said game completed by the player and a duration of game play of said game b the player, a first number of achievable elements that are exchangeable b the player to unlock additional features of said game that affect a game play of said game but that do not affect the game outcome of said game, wherein at least one of the additional features includes an increased speed of game play for said game and wherein said achievable elements do not affect the game outcome of said game; and incrementing, by the game rules server of the gaming platform, the allocated first number of achievable elements to a set of achievable elements associated with the player.

4. A method, comprising:

receiving, from a client device associated with a player and via one or more first electronic communications sent over one or more computer networks to an external client server of a gaming platform having a plurality of servers, a first request to play a game via the one or more computer networks;

transmitting, based at least in part on the received first request and via one or more second electronic communications sent over the one or more computer networks, information indicative of a second request to a deck server of the gaming-platform for game pieces selected by the deck server according to a set of game rules for said game;

receiving, based at least in part on the second request and via one or more third electronic communications sent over the one or more computer networks, information indicative of the selected game pieces from said deck server;

generating, by a game rules server of the gaming platform and based at least in part on the selected game pieces and on the set of game rules, a game outcome for said game, generating of the game outcome including transmitting one or more fourth electronic communications indicative of the generated game outcome over the one or more computer networks to the external client server of the gaming platform;

allocating to the player, by the gaming platform and based at least in part on at least one of a number of rounds of said game completed by the player and a duration of game play of said game by the player, a first number of achievable elements that are exchangeable by the player to unlock additional features of said game that affect a game play of said game but that do not affect the game outcome of said game, wherein at least one of the additional features includes a reduced duration of one or more graphical sequences included in said game and wherein said achievable elements do not affect the game outcome of said game; and incrementing, by the game rules server of the gaming platform, the allocated first number of achievable elements to a set of achievable elements associated with the player.

5. A method, comprising:

receiving, from a client device associated with a player and via one or more first electronic communications sent over one or more computer networks to an external client server of a gaming platform having a plurality of servers, a first request to play a game via the one or more computer networks;

transmitting, based at least in part on the received first request and via one or more second electronic communications sent over the one or more computer networks, information indicative of a second request to a deck server of the gaming platform for game pieces selected by the deck server according to a set of game rules for said game;

receiving, based at least in part on the second request and via one or more third electronic communications sent over the one or more computer networks, information indicative of the selected game pieces from said deck server;

generating, by a game rules server of the gaming platform and based at least in part on the selected game pieces and on the set of game rules, a game outcome for said game, the generating of the game outcome including transmitting one or more fourth electronic communications indicative of the generated game outcome over the one or more computer networks to the external client server of the gaming platform;

allocating to the player, the gaming platform and based at least in part on at least one of a number of rounds of said game completed by the player and a duration of game play of said game by the player, a first number of achievable elements that are exchangeable by the player to unlock additional features of said game that affect a game play of said game but that do not affect the game outcome of said game, wherein at least one of the additional features includes a reduced duration of one or more graphical sequences included in said game, the one or more graphical sequences including a graphical sequence that depicts a randomized event and wherein said achievable elements do not affect the game outcome of said game; and incrementing, by the game rules server of the gaming platform, the allocated first number of achievable elements to a set of achievable elements associated with the player.

6. A method, comprising:

receiving a first request to play a game over a computer network;

generating a second request to a deck server for random game pieces according to rules of said game;

receiving said random game pieces from said deck server, wherein said random game pieces are received after receiving all end user activity related to said game according to said rules of said game;

generating an outcome based upon said random game pieces and said rules of said game;

allocating a first number of achievable elements based at least in part on at least one of a number of rounds of said game completed or a time played, said achievable elements exchangeable by an end user playing said game to increase a speed of one or more graphical sequences of said game, said increased speed of said one or more graphical sequences of said game which does not affect said outcome of said game, said achievable elements which do not affect said outcome of said game; and adding the allocated first number of achievable elements to a number of achievable elements associated with the end user playing the game.

7. A method, comprising:

receiving a first request to play a game over a computer network;

generating a second request to a deck server for random game pieces according to rules of said game;

receiving said random game pieces from said deck server, wherein said random game pieces are received after receiving all end user activity related to said game according to said rules of said game;

generating an outcome based upon said random game pieces and said rules of said game;

allocating a first number of achievable elements to an end user based at least in part on at least one of a number of said games completed by the end user, a total amount of wagers of said end user in one or more games, a total amount of winnings by said end user, and a total amount of losses by said end user, said achievable elements exchangeable by said end user playing said game to increase a speed of one or more graphical sequences of said game, said increased speed of said one or more graphical sequences of said game which does not affect said outcome of said game; said achievable elements which do not affect said outcome of said game; and adding the allocated first number of achievable elements to a number of achievable elements associated with said end user playing the game.

* * * * *